US012774822B2

(12) United States Patent
Floyd, Jr. et al.

(10) Patent No.: US 12,774,822 B2
(45) Date of Patent: Oct. 27, 2026

(54) TABLET HOLDER, SUNSHADE, AND HEATED HELMET BOX FOR CLIMATE CONTROLLED BENCH

(71) Applicant: Bourne Creations, Inc., Beachwood, OH (US)

(72) Inventors: Franklin B. Floyd, Jr., Hunting Valley, OH (US); Franklin B. Floyd, III, Shaker Heights, OH (US)

(73) Assignee: Bourne Creations, Inc., Beachwood, OH (US)

( * ) Notice: Subject to any disclaimer, the term of this patent is extended or adjusted under 35 U.S.C. 154(b) by 0 days.

(21) Appl. No.: 19/468,358

(22) Filed: Feb. 3, 2026

(65) Prior Publication Data

US 2026/0227081 A1 Aug. 6, 2026

Related U.S. Application Data

(63) Continuation of application No. 19/288,015, filed on Aug. 1, 2025.

(60) Provisional application No. 63/710,561, filed on Oct. 22, 2024, provisional application No. 63/679,349, filed on Aug. 5, 2024.

(51) Int. Cl.

| | |
|---|---|
| ***F24F 5/00*** | (2006.01) |
| ***A47C 7/66*** | (2006.01) |
| ***A47C 7/72*** | (2006.01) |
| ***A47C 7/74*** | (2006.01) |

(52) U.S. Cl.

CPC ..... *F24F 5/0096* (2013.01); *A47C 7/666* (2018.08); *A47C 7/723* (2018.08); *A47C 7/744* (2013.01); *A47C 7/748* (2013.01); *F24F 2221/10* (2013.01)

(58) Field of Classification Search

CPC ..... A47C 7/748; A47C 7/744; A47C 7/723; A47C 7/666; F24F 5/0096; F24F 2221/10; H05B 1/00

USPC ..... 297/180.12, 180.1; 219/217, 213; 128/376, 377

See application file for complete search history.

(56) References Cited

U.S. PATENT DOCUMENTS 3,745,305 A * 7/1973 Reed ..... A61F 7/02 219/217

3,858,643 A * 1/1975 Reed ..... A47C 11/00 165/47

(Continued)

FOREIGN PATENT DOCUMENTS

WO WO-2024/107907 A1 5/2024

OTHER PUBLICATIONS

International Search Report for PCT/US2023/079924, 4 pages (mailed Mar. 5, 2024).

(Continued)

*Primary Examiner* — Maria E Graber

(74) *Attorney, Agent, or Firm* — Choate, Hall & Stewart LLP; Charles E. Lyon; Peter A. Flynn

(57) ABSTRACT

A system includes: a climate-controlled bench; a retractable shade positioned near the climate-controlled bench and including multiple foot supports coupled to the climate-controlled bench; and at least one tablet holder attached to a component of the climate-controlled bench. In some embodiments, the system instead, or in addition, includes at least one HVAC unit and at least one heater box, both of which are thermally and/or fluidly coupled to at least one other component of the system.

17 Claims, 12 Drawing Sheets

(56) References Cited

U.S. PATENT DOCUMENTS

| | | | | |
|---|---|---|---|---|
| 4,134,615 | A * | 1/1979 | Jenkins | A47C 7/748 297/180.13 |
| 4,314,727 | A * | 2/1982 | Potts | A47C 7/666 297/184.12 |
| 5,015,032 | A * | 5/1991 | Felling | A47C 7/666 297/301.7 |
| D460,283 | S | 7/2002 | Floyd, Jr. | |
| 6,435,608 | B1 * | 8/2002 | Floyd, Jr. | A47C 7/748 297/180.12 |
| 6,776,453 | B1 | 8/2004 | Floyd, Jr. | |
| 6,863,342 | B2 * | 3/2005 | Floyd, Jr. | A47C 11/00 297/180.13 |
| 9,435,554 | B2 * | 9/2016 | Cothren | F24F 5/0096 |
| 10,472,838 | B1 | 11/2019 | MacGregor | |
| 10,551,088 | B2 * | 2/2020 | Cothren | F24F 5/0096 |
| 10,570,638 | B2 * | 2/2020 | Clark | E04H 15/18 |
| 10,779,656 | B2 * | 9/2020 | Cothren | A47C 11/00 |
| 11,015,363 | B2 * | 5/2021 | Clark | A47C 11/00 |
| 11,654,081 | B2 * | 5/2023 | Sauer | A47C 1/14 4/531 |
| 11,759,019 | B2 * | 9/2023 | Billman | A47C 7/666 297/184.11 |
| 2002/0175541 | A1 * | 11/2002 | Floyd, Jr. | A47C 7/744 297/180.12 |
| 2013/0026800 | A1 * | 1/2013 | Floyd, Jr. | A47C 7/748 297/180.13 |
| 2013/0327141 | A1 | 12/2013 | Floyd, Jr. et al. | |
| 2014/0360697 | A1 * | 12/2014 | Brandreth | F24H 3/02 165/48.1 |
| 2017/0164742 | A1 * | 6/2017 | Hay | A47C 1/143 |
| 2020/0000238 | A1 * | 1/2020 | Cothren | A47C 7/744 |
| 2026/0036312 | A1 * | 2/2026 | Floyd, Jr. | A47C 11/00 |

OTHER PUBLICATIONS

Written Opinion for PCT/US2023/079924, 8 pages (mailed Mar. 5, 2024).

* cited by examiner

TABLET HOLDER, SUNSHADE, AND HEATED HELMET BOX FOR CLIMATE CONTROLLED BENCH

CROSS-REFERENCE TO RELATED APPLICATIONS

The present application is a continuation of U.S. patent application Ser. No. 19/288,015, filed Aug. 1, 2025, which claims the benefit of and priority to U.S. Provisional Patent Application No. 63/679,349 filed Aug. 5, 2024, and U.S. Provisional Patent Application No. 63/710,561 filed Oct. 22, 2024, the contents of each of which are herein incorporated by reference.

FIELD

The subject matter described herein relates generally to devices designed to warm or cool persons participating in activities in extreme temperature conditions. More particularly, the present embodiments relate to seating devices useful for warming or cooling the bodies and equipment of participants in hot or cold weather activities including occupational activities (for example, industrial working environments), lifestyle activities such as skiing, and/or at athletic events such as football, rugby, soccer, field hockey, pond hockey, curling, ice fishing, tennis, baseball, golf, lacrosse, and/or other outdoor sport practices and games.

BACKGROUND

The desire to provide a heat or air-conditioned source for those activities including observers or passive participants in athletic events who are not actively engaged in the activities athletic contest (coaches, substitute players, the offensive or defensive squads that are alternatively on the sideline or on the playing field, etc.) has led to the development and use of various personnel warming and/or cooling devices. Known warmers include torpedo heaters and other space heaters designed to blow hot air into a general area, heated benches for seating, and heated bench-like structures that can be used as seats or that otherwise serve as radiant sources of heat. Current heating technologies often provide incomplete, insufficient, and/or only localized heating or cooling. In addition, in harsh work environments (for example, outdoor work environments in hot, humid, and/or frigid conditions), work may be nearly unbearable and may present both health risks and productivity loss.

SUMMARY OF THE INVENTION

The present disclosed embodiments include systems and methods for heating and cooling benches (for example, for use by participants in outdoor sporting events or industrial and/or lifestyle applications). Conditions within manufacturing plants, steel mills, paper mills, and other production facilities may include extreme heat and humidity conditions due to heat generated by the underlying processes and/or due to poor ventilation and air circulation. In other environment such as within industrial refrigeration environments, at dockyards, on ships in frigid conditions, and elsewhere, workers may have to go to extreme measures to keep warm. The benches of the present embodiments provide a localized controlled climate allowing those in extreme heat environments to realize relief from the heat, while also allowing those in extreme cold environments an opportunity to periodically warm up. Not only does the relief from harsh environments provide a reprieve for the worker, it also may lead to productivity enhancements since numbing hands or feet can hinder a worker's progress and lead to accidents, while dehydration (associated with hot environments) has been shown to lead to a drop in a person's physical performance. In addition, the relief provided by the benches of the present embodiments temporarily lowers a worker's health risks.

In other applications such as "lifestyle" applications, for example, at ski resorts, users may appreciate the benches of the present embodiments in a heating configuration when outdoor entertainment (dining and other activities) are occurring in cold conditions. The benches of the present embodiments provide a useful alternative to heat lamps, which provide very localized heating, but are not designed to provide heating to specific areas of the body. In addition, the benches of the present embodiments may be used to warm ski equipment when it is not in use.

In one aspect, the present embodiments are directed to a tablet holder that may be used in connection with the climate-controlled benches described herein, the tablet holder including: a pocket portion sized and shaped to hold an electronic tablet; and an attachment assembly for attaching the tablet holder to one or more external structures, wherein the attachment assembly is oriented in a plane that is substantially perpendicular to a plane in which the pocket portion is oriented.

In some embodiments, the pocket portion includes a front surface and a rear surface, each of which define a plane that is perpendicular to the plane defined by the attachment assembly.

In some embodiments, when an electronic tablet is seated within the pocket portion, the pocket portion is oriented in a vertical plane, and the attachment assembly is oriented in a horizontal plane.

In some embodiments, the pocket portion includes an internal thickness in a range from about 0.5 inches to about 0.9 inches.

In some embodiments, the pocket portion includes: a width in a range from about 9 inches to about 12 inches; and a height in a range from about 2 inches to about 6 inches.

In some embodiments, the front surface includes an array of air holes disposed therethrough; and the rear surface includes an elongated gap disposed therein.

In another aspect, the present embodiments are direct to a retractable shade that may be used in connection with the climate-controlled benches described herein, the retractable shade including: a shade portion including an opaque flexible material; multiple vertical members, each vertical member rotatably coupled to the shade portion; and multiple telescoping supports, each telescoping support rotatably coupled to both the shade portion and a vertical member.

In some embodiments, the shade includes multiple foot supports, wherein each foot support is horizontally oriented and fixedly coupled to a vertical member.

In some embodiments, the opaque flexible material includes at least one of Gore-Tex® (i.e., expanded polytetrafluoroethylene (ePTFE)), canvas, polyester, nylon, and linen.

In some embodiments, the shade portion is deployable at different angles defined with the vertical members by expanding or contracting the telescoping members, and the opaque flexible material is coupled to at least one spring-loaded roller disposed within a side support of the shade portion such that the opaque flexible material may be selectively extended across shade portion when in use, and/or wound around the at least one spring-loaded roller when not in use.

In another aspect, the present embodiments are directed to a system including: a climate-controlled bench; a retractable shade including a foot support coupled to the climate-controlled bench; and the tablet holder of claim 1 attached to a portion of the climate-controlled bench.

In some embodiments, the retractable shade includes the shade as described herein.

In some embodiments, the system includes a tablet positioned within the tablet holder.

In some embodiments, the climate-controlled bench includes one or more vertical heating and/or cooling components shaped and sized to support one or more pieces of equipment.

In some embodiments, the system includes a helmet positioned on the one or more vertical heating and/or cooling components.

In some embodiments, an attachment member of the tablet holder is disposed around a stem portion of the one or more vertical heating and/or cooling components.

In another aspect, the present embodiments are directed to a method of enhancing heat transfer in a vicinity of a climate-controlled bench system, the climate-controlled bench including an air diffusor configured to discharge heated and/or cooled air at a neck area of a person sitting on the bench, the system including a tablet holder attached to a component of the bench, the tablet holder holding a tablet, the tablet holder and tablet being positioned within an air stream of the air diffusor, the method including: removing the tablet from the tablet holder such that at least a portion of the air discharged from the air diffusor may pass through tablet holder.

In some embodiments, the method further includes positioning the tablet holder in a rear portion of the climate-controlled bench, thereby allowing air to be discharged from the diffusor unhindered.

In some embodiments, the tablet includes an array of air holes disposed therethrough and/or an elongated gap disposed therein, thereby enabling air to pass therethrough when the tablet is not positioned within the tablet holder.

In some embodiments, positioning the tablet holder in a rear portion of the climate-controlled bench includes: vertically raising the tablet holder; and rotating the tablet holder approximately 180 degrees about a component of the climate-controlled bench to which it is rotatably coupled.

In another aspect, the present embodiments are directed to a system including: a substantially hollow bench configured to discharge climate-controlled air from an interior of the bench to an exterior of the bench; at least one HVAC unit fluidly and/or thermally coupled to the interior of the bench and configured to deliver the climate-controlled air to the interior of the bench; and at least one heater box fluidly and/or thermally coupled to at least one of the HVAC unit and the climate-controlled bench.

In some embodiments, the HVAC unit includes a first HVAC unit coupled to the hollow bench and a second HVAC unit coupled to the heater box.

In some embodiments, the HVAC unit is coupled to both the hollow bench and the heater box.

In some embodiments, the heater unit is fluidly and/or thermally coupled to the hollow bench.

In some embodiments, the heater box includes a pentagonal cross-section extending across a lengthwise dimension of the heater box.

In some embodiments, the heater box includes: a front door that is rotatably coupled via a hinge along a top surface to the rest of the heater box such that it is configured to rotate open; a front door that is magnetically coupled to the rest of the heater box such that it remains closed when in use and when not opened by a user; multiple side ports for fluidly coupling with one or more hoses that are coupled to the HVAC unit; and/or a transparent top surface.

In some embodiments, the hollow bench includes at least one removable blank for thermally and/or fluidly coupling to the heater box.

In some embodiments, the heater box includes multiple rear surfaces and/or planes that are sized and angled to match corresponding multiple rear surfaces of a diffusor manifold of the bench such that the multiple rear surfaces and/or planes of the heater box are in contact with the corresponding multiple rear surfaces of the diffusor manifold when in operation.

In some embodiments, the hollow bench is directly thermally coupled to both the HVAC unit and the heater box.

In some embodiments, the heater box includes at least one non-orthogonal exterior surface.

In some embodiments, the heater box includes one or more side handles and/or front handles.

In some embodiments, the heater box includes at least one polymerized or rubberized layer disposed on at least one exterior surface of the heater box.

In some embodiments, the heater box includes a first compartment, a second compartment, and a third compartment disposed within an interior volume of the heater box.

In some embodiments, at least two of the first, second, and third compartments are sized such that a full-size football helmet may be placed therewithin, and at least one of the first, second, and third compartments is smaller than the other two compartments.

In some embodiments, the heater box includes multiple dividing walls separating and at least partially defining the first, second, and third compartments, and each dividing wall of the multiple dividing walls includes at least one cross-connect hole disposed therein, the cross-connect hole fluidly connecting at least one of the first, second, and third compartments to an adjacent one of the first, second, and third compartments.

In some embodiments, the system includes: at least one tablet holder attached to the substantially hollow bench; and a retractable shade including a foot support coupled to the substantially hollow bench.

In another aspect, the present embodiments are directed to an air-conditioned bench including: a seat bottom portion including a first plurality of perforations fluidly connecting an interior or exterior of the bench to an exterior of the bench; a back support wall including a second plurality of perforations fluidly connecting the interior of the bench to the exterior of the bench; and a fan disposed in the interior of the bench directing air from the interior of the bench to each of the first plurality of perforations and the second plurality of perforations. In some embodiments, the bench may include a diffusor located at shoulder level, the diffusor being integral to the bench construction and fluidly connecting an interior of the bench to an exterior of the bench.

In some embodiments, the bench includes a length in a range from about 42 inches to about 54 inches. In some embodiments, the bench includes a length in a range from about 42 inches to about 172 inches. In some embodiments, the bench includes a length in a range from about 30 inches to about 200 inches.

In some embodiments, the bench includes a retractable tray.

In some embodiments, the retractable tray is hingedly connected to a side of the bench such that it is configured to be vertically stored flat against the side of the bench when the retractable tray is not in use.

In some embodiments, the bench includes a sunshade. In some embodiments, the sunshade is separable from the bench and able to stand on its own. In some embodiments, the shade is integrated into the bench design.

In some embodiments, the sunshade includes one or more vertical support members and one or more contoured shade portions.

In some embodiments, the bench includes a retractable wheel assembly.

In some embodiments, the retractable wheel assembly includes a plurality of wheels coupled to a plurality of castors.

In some embodiments, the bench is composed of fiberglass.

In some embodiments, the seat bottom portion is oriented at an angle of about 4 degrees to about 10 degrees from the horizontal plane.

In some embodiments, the back support wall is oriented at an angle from about 12 degrees to about 20 degrees from the vertical plane.

In another aspect, the present embodiments are directed to a heated or air-conditioned bench assembly including: a bench, and an air-conditioning unit fluidly coupled to an interior of the bench, the bench including: a seat bottom portion; a back support wall; and a fan disposed in the interior of the bench directing air from the interior of the bench to a plurality of perforations disposed in the seat bottom portion and/or the back support wall.

In some embodiments, the air-conditioning unit includes at least one cooling device or water-cooled device for AC, or gas or electric unit for heating including a refrigeration cycle including refrigerant.

In some embodiments, the bench includes a conduit fluidly coupling the interior of the bench to the heating and/or air-conditioning unit, the fan being disposed within the conduit or external to the conduit.

In some embodiments, in operation, the assembly is configured to operate using a voltage of 120 volts, a voltage of 208/230 volts in a 3-phase arrangement, and/or other suitable voltage arrangements.

In some embodiments, the heating or air-conditioning unit includes at least one air discharge shell, or diffusor directing air from an interior of the air-conditioning unit to an exterior of the air-conditioning unit.

In some embodiments, the air discharge shell or diffusor directs air away from the bench.

In some embodiments, the bench includes multiple hot hat features or structures acting as heaters for helmets, gloves, accessories, articles of clothing, equipment, and/or other items. In some embodiments, the hot hat features are fluidly coupled to an interior of the bench.

In some embodiments, the assembly includes a remote control communicatively coupled to a control unit of the air-conditioning unit for selectively controlling the bench assembly to operate in each of a heating mode of operation, a cooling mode of operation, and a fan mode of operation.

In some embodiments, in a fan mode of operation, unconditioned ambient air is distributed by the fan to the plurality of perforations. In some embodiments, the bench includes a fan or blower located in the interior or exterior of the bench.

In another aspect, the present embodiments are directed to: a climate-controlled bench including: a substantially hollow shell forming an outer structure of the bench, the substantially hollow shell including at least one air inlet disposed therethrough; an HVAC unit fluidly coupled to an interior of the bench, the HVAC unit providing heated, cooled, and/or ambient air to the interior of the bench; and a diffusor manifold including a diffusor through which air flows from the interior of the bench to an exterior of the bench, the diffusor manifold fluidly coupled to the interior of the bench. The substantially hollow shell forms a fluid duct to the diffusor manifold.

In some embodiments, the substantially hollow shell forms the fluid duct to the diffusor manifold without any internal structural ductwork disposed therein.

In some embodiments, the HVAC unit is located within the substantially hollow shell.

In some embodiments, the HVAC unit is located external to the substantially hollow shell.

In some embodiments, the HVAC unit is fluidly coupled to the interior of the bench via the at least one air inlet.

In some embodiments, the substantially hollow shell includes: a substantially vertical rear wall; a top contoured portion; a middle contoured portion; and a back support wall including an angled linear portion disposed between the top contoured portion and the middle contoured portion.

In some embodiments, the angled linear portion is oriented at an angle from about 15 degrees to about 23 degrees relative to the substantially vertical rear wall.

In another aspect, the present embodiments are directed to a bench system including: multiple benches, each including a substantially hollow shell that includes a side wall on either end with at least one handle disposed therethrough, wherein each bench is fluidly coupled to an adjacent bench via the at least one handle.

The contents of U.S. Pat. No. 6,863,342 are incorporated herein by reference in their entirety.

Throughout the description, where an apparatus, systems or compositions are described as having, including, or including specific components, or where methods are described as having, including, or comprising specific steps, it is contemplated that, additionally, there are systems, apparatuses or compositions of the present disclosed embodiments that consist essentially of, or consist of, the recited components, and that there are methods according to the present embodiments that consist essentially of, or consist of, the recited processing steps.

It should be understood that the order of steps or order for performing certain action is immaterial as long as the invention remains operable. Moreover, two or more steps or actions may be conducted simultaneously.

The following description is for illustration and exemplification of the disclosure only, and is not intended to limit the invention to the specific embodiments described.

The mention herein of any publication, for example, in the Background section, is not an admission that the publication serves as prior art with respect to any of the present claims. The Background section is presented for purposes of clarity and is not meant as a description of prior art with respect to any claim.

BRIEF DESCRIPTION OF THE DRAWINGS

A full and enabling disclosure of the present disclosed embodiments, including the best mode thereof, directed to one of ordinary skill in the art, is set forth in the specification, which makes reference to the appended figures, in which.

DESCRIPTION OF CERTAIN ASPECTS OF THE DISCLOSED EMBODIMENTS

Figure 1:
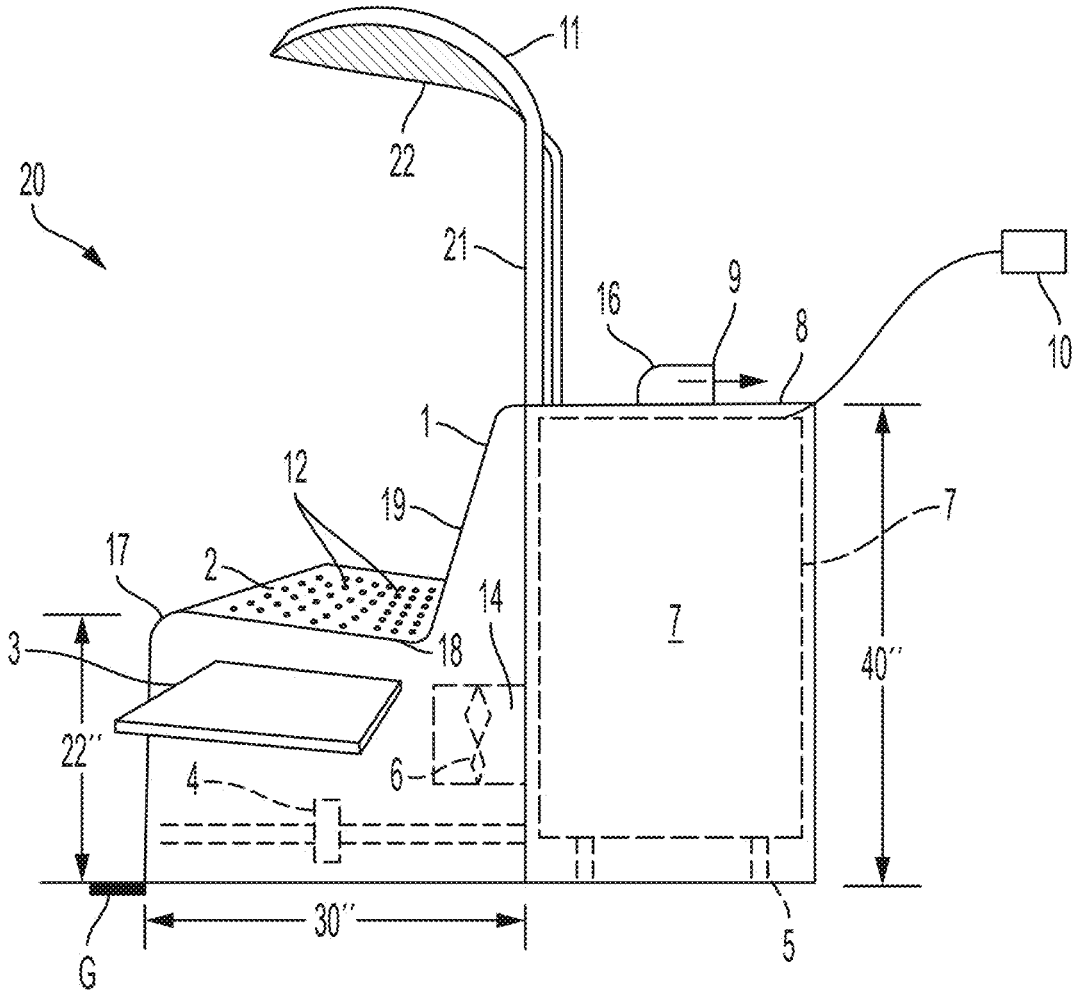
FIG. 1 illustrates a side view of a climate controlled bench, according to the present embodiments.

Reference will now be made in detail to the present disclosed embodiments, one or more examples of which are illustrated in the accompanying drawings. The detailed description uses numerical and/or letter designations to refer to features in the drawings. Like or similar designations in the drawings and description have been used to refer to like or similar parts of the present embodiments.

FIG. 1 illustrates a side view of an air-conditioned and heated bench 1 (i.e., a climate controlled bench), as part of a bench assembly 20, according to the present embodiments. The bench assembly 20 may generally include the bench 1, as well as an air-conditioning unit 7. In some embodiments, the bench 1 may be composed of fiberglass materials and/or other suitable materials such as thermoplastics, polymers, composite materials (including composites that include metallic materials), and other materials that are sufficiently robust and resilient to withstand high stresses. The bench 1 may include a seating area 2 (or seat bottom portion 2) that may include a plurality of perforations or air holes 12 to enhance the heating and/or cooling of the person or equipment positioned on the seating area 2. The bench 1 may also include one or more retractable tables 3 (for example, on either end (or both ends)) to allow users to place equipment, water bottles, food, tablets, and/or other items near the bench. The retractable table 3 may be hingedly connected to the side(s) of the bench 1 such that it may be vertically stored (i.e., flat against the side of the bench 1) when not in use.

Figure 2:
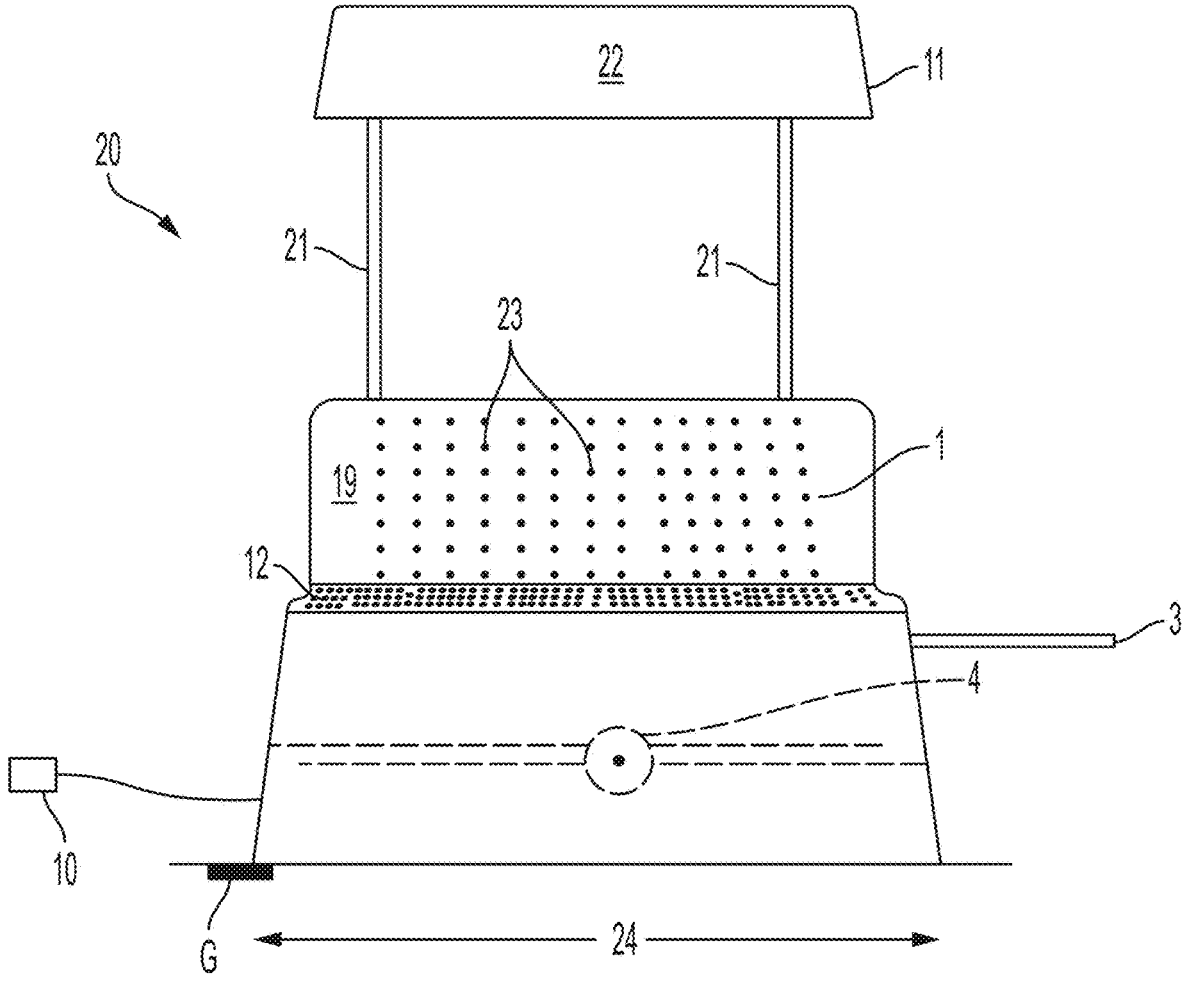
FIG. 2 illustrates a front view of a climate controlled bench, according to the present embodiments.
Figure 3:
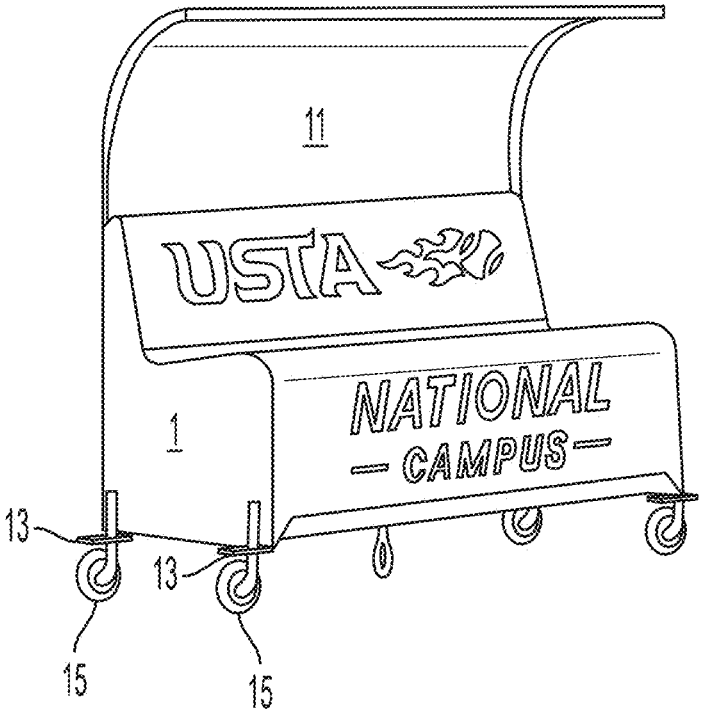
FIG. 3 illustrates a front perspective view of a climate controlled bench, according to the present embodiments.

Referring still to FIG. 1, the bench 1 may include a retractable wheel assembly 4, shown in a retracted position in FIG. 1 (and FIG. 2), and shown in an extended position in FIG. 3. In some embodiments, the retractable wheel assembly 4 may include a plurality of wheels 15 mounted to a bottom surface of the bench 1 via a plurality of castors 13, as shown in FIG. 3. The castors 13 themselves may be mounted or hingedly coupled to a bottom surface of the bench 1 such that they may be easily moved between a retracted position and an extended position. When the bench 1 is positioned at a desired location, retracting the wheels 15 helps to further stabilize the bench 1, reducing the likelihood that it will tip over. The bench assembly 20 may include an air-conditioning unit 7 that is configured to be operatively coupled to the back of the bench 1. For example, when the bench 1, air-conditioning unit 7, and and/or bench assembly 20 is being transported or maneuvered from one location to another, it may be preferable for the air-conditioning unit 7 to be detached from the bench 1. In operation, the air-conditioning unit 7 may be attached to the bench 1 such that cool air (or warm air, as the case may be) may be provided to the bench via the air-conditioning unit 7.

Referring still to FIG. 1, the air-conditioning unit 7 may include a plurality of A/C unit wheels 5, allowing easy maneuvering of the air-conditioning unit 7. The bench 1 may include an axial fan 6 disposed within a conduit 14 located within a rear portion of the bench 1. The conduit 14 may be fluidly coupled to the air-conditioning unit 7. When the axial fan 6 is operating, it suctions cool air (or warm air, as the case may be) into the interior of the bench 1. In some embodiments, the air-conditioning unit 7 may be configured to run on 120V such that it may be plugged into any standard wall outlet (and thus does not require a special 220V or 480V power supply). The entire air-conditioning unit 7 may be disposed within a protective fiberglass shell 8 to help protect the air-conditioning unit 7, and to reduce the loss of heated and/or cooled air from the air-conditioning unit 7 (i.e., to the environment). The protective fiberglass shell 8 may include a warm air discharge shell 9, for directing heat that is being rejected to the environment (when the bench is in cooling mode) away from the perforated seat area 2. The warm air discharge shell 9 may include a contoured portion 16 to help direct warm air in a rearward direction, as shown in FIG. 1. Similarly, in heating mode, the air discharge shell 9 directs any cool air rejected from the air-conditioning unit 7 away from the perforated seating area 2 (and anyone sitting thereon).

Still referring to FIG. 1, the bench assembly 20 may include a remote control 10, electrically and/or communicatively coupled to an A/C control unit (not shown) disposed within and/or on the protective fiberglass shell 8. The remote control 10 may be used to 1) turn the air-conditioning unit 7 on and off, 2) switch between heating, cooling, and fan only modes of operation, and 3) adjust the magnitude or degree of heating and cooling (for example, via fan speed adjustments and/or the temperature of the air being discharged from the air-conditioning unit 7 to the bench 1, via the conduit 14 (for example, by selecting drawing more or less electrical current into the air-conditioning unit)). In some embodiments, the remote control 10 may be wirelessly coupled to the A/C control unit. The bench assembly may include a retractable sunshade 11 to reduce sun exposure to those sitting on the bench 1, and to deflect sunlight when the bench 1 is in cooling mode, thereby helping to keep the environmental temperature on and/or in the vicinity of the bench 1 cooler. In some embodiments, the retractable sunshade 11 may include one or more vertical members 21 supporting a contoured shade member 22. In some embodiments, the one or more vertical members 21 may be retractable against a rear wall of the bench 1, while the contoured shade member 22 may be flexible (i.e., with memory shape capabilities) such that it may be stored in a vertical (i.e., flat) position as well against the rear wall of the bench 1. When not stored, the contoured shade member 22 may bend or flex to reform a contoured shape (i.e., via shape memory). In some embodiments, the contoured shade member 22 may be detachable from the one or more vertical members when not in use. In some embodiments, the entire retractable sunshade 11 may be contoured and may be retractable to a stowed position within the fiberglass bench 1, as shown in FIG. 3, or alternatively may be completely detached from the bench 1.

Referring still to FIG. 1, the seating area 2 may slope downward at an angle from a front corner 17 (which itself may be curved, angled, chamfered, etc. to avoid sharp angles) to a rear corner 18. In some embodiments, the seating area 2 slopes downward at an angle of from about 4 to 10 degrees, or from about 5 to 8 degrees, or from about 6 to 7 degrees (i.e., from a horizontal plane). A back support wall 19 of the bench may be oriented at an angle of from about 12 to 20 degrees, or from about 14 to 18 degrees, or from about 15 to 17 degrees, or from about 16 degrees (i.e., from a vertical plane). In some embodiments, a width of the bench may be about 30 inches (as shown in FIG. 1) or from about 29 to about 31 inches, or from about 28 to about 32 inches, or from about 27 to about 33 inches. In some embodiments, both the air-conditioning unit 7 and the bench 1 may include a height of about 40 inches, or from about 38 inches to about 42 inches, or from about 36 inches to about 44 inches. In some embodiments, the highest portion of the front corner 17 may be disposed about 20, 21, 22, 23, or 24 inches above the ground (marked as "G" in FIG. 1), and may slope downward to the rear corner 18, which may be disposed at a height or about 0.5, 1, 1.5, and/or 2 inches below the height of the front corner 17.

FIG. 2 illustrates a front view of an air-conditioned and heated bench 1 (i.e., a climate controlled bench) including the sunshade 11, contoured shade portion 22, one or more vertical members 21, back support wall 19, retractable tray 3, remote control 10, first plurality of perforations 12 (disposed in the seating area 2 (shown in FIG. 1), and retractable wheel assembly 4, according to the present embodiments. FIG. 2 also illustrates a second plurality of perforations 23 disposed in the back support wall 19, each perforation of the second plurality of perforations 23 fluidly connecting the interior of the bench 1 to an exterior of the bench 1, and configured to direct conditioned and/or ambient air to a person sitting on the bench 1. The bench 1 may include a length 24 of about 48 inches, or from about 45 inches to about 51 inches, or from about 42 inches to about 54 inches.

FIG. 3 illustrates a front perspective view of an air-conditioned and heated bench 1 (i.e., a climate controlled bench), including a contoured, retractable sunshade 11, wheels 15, and castors 13, according to the present embodiments. FIG. 3 illustrates the wheels 15 and castors 13 in an extended (i.e., rather than retracted) position, thereby easing the maneuvering of the bench 1.

In operation, the air-conditioning unit 7 may provide cooled air or alternatively, heated air to both the first plurality of perforations 12 disposed in the perforated seat area, as well as to a second plurality of perforations 23 disposed in the back support wall 19 of the bench 1. The configuration of the present embodiments provides convective cooling or heating to the legs, rear, back, shoulders, neck, and/or head areas of any person(s) sitting on the bench 1. In some embodiments, the bench 1 may include a fan mode such that the axial fan 6 directs untreated ambient air to both the first and second pluralities of perforations 12, 23, thereby providing a moderate amount of cooling to any person(s) sitting on the bench 1 (i.e., via enhanced evaporative cooling in concert with any sweat or moisture on the person(s) sitting on the bench 1) while simultaneously reducing the power usage of the bench 1. The axial fan 6 draws cooled, heated, and/or ambient air from the air-conditioning unit 7 into the interior of the bench 1, and directs it to the first and second pluralities of perforations 12, 23 via one or more additional internal conduits.

The air-conditioning unit 7 may include both heating elements and cooling elements. For example, in some embodiments, the air-conditioning unit 7 may include at least one heat exchanger (not shown) configured to exchange heat with ambient air that enters the air-conditioning unit 7 via one or more inlet vents (not shown). The heat exchanger may be thermally coupled to both a heating element (for example, a resistive heating device and/or an induction heater) and a cooling element (for example, a cooling device including a refrigeration cycle, i.e., including refrigerant, etc.). When the bench is used in fan mode, the air-conditioning unit 7 is not needed. As such, in some embodiments, the bench may be used with the conduit 14 open directly to ambient air (for example, in connection with a vent, louvers, and/or filter) such that ambient air is circulated to both the first and second pluralities of perforations 12, 23, as described herein, without any heating and/or cooling from the air-conditioning unit 7. By placing heating and cooling elements in thermal communication with the interior of the bench 1, by disposing an axial fan 6 in the interior of the bench 1 to draw air in and distribute it to the first and second pluralities of perforations, and by disposing first and second pluralities of perforations to deliver convective heating and/or cooling to the person(s) sitting on the bench 1, the present disclosure provides effective temperature management to users in all weather conditions, even when the air-conditioning unit 7 is not in operation.

Figure 4:
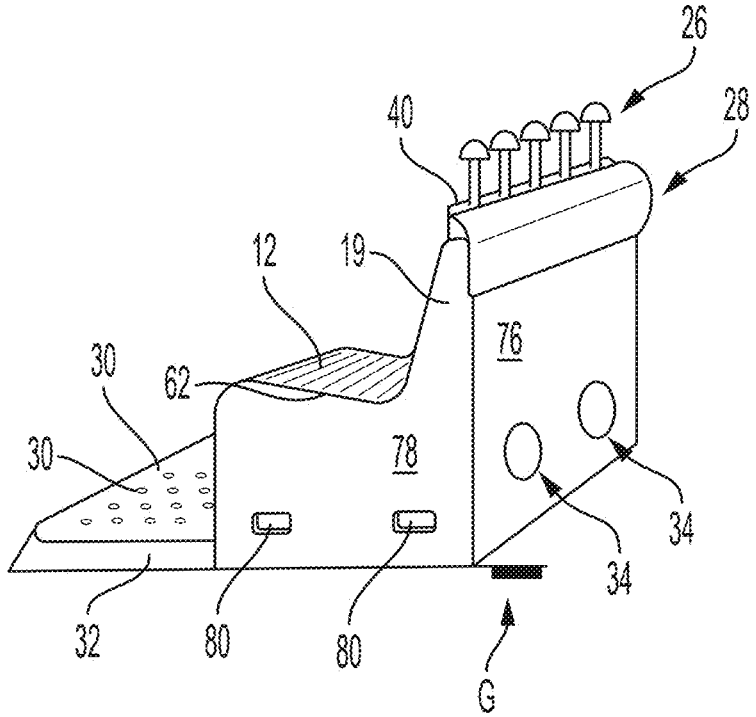
FIG. 4 illustrates a side perspective view of a climate controlled bench, according to the present embodiments.

FIG. 4 illustrates a side perspective view of a climate controlled bench 35, according to the present embodiments. In addition to the plurality of perforations 12 disposed within the seat portion 62, the bench 35 may also include a foot deck 32 that includes a plurality of perforations 30 disposed therein for heating and/or cooling the feet of people sitting on the bench 35. For example, an interior of the foot deck 32 may be connected (i.e., fluidly connected) to an interior of the bench 35 such that heated and/or air conditioned/cooled air in the interior of the bench 35 flows out of the perforations 30 in the foot deck 32, which extends in a forward direction from the base of the bench 35 (i.e., from the perspective of a person sitting on the bench 35). In some embodiments, the bench 35 may include one or more handles 80 disposed in one or both side walls 78 of the bench 35 to facilitate movement of the bench. In some embodiments, the handles 80 do not create a fluid passageway through the side wall(s) 78 of the bench. In some embodiments, the handles 80 are plugged during use to prevent heated and/or cooled air from flowing therethrough. In some embodiments, the handles 80 provide an opening to fluidly connect the interior of a first bench 35 to an interior of an adjacent bench 35. The handles 80, in some embodiments, may include substantially rectangular cross-sectional areas (to match the geometry or dimensions of a human hand), and may act both as handles 80 during movement of the bench, and fluid passageways to one or more adjacent benches 35 when the bench 35 is in use.

Referring still to FIG. 4, in some embodiments, the bench 35 may include one or more air inlets 34 disposed in a rear wall 76 of the bench 35. The one or more air inlets 34 may be about 12 inches in diameter, or from about 10 inches to about 14 inches, and or from about 6 inches to about 16 inches, and or from about 6 inches to about 12 inches, and or from about 4 inches to about 10 inches, and/or other sub-ranges therebetween. The one or more air inlets 34 may be used to deliver heated, cooled, and/or ambient air from an external source (for example, from an HVAC unit 36 shown in FIG. 7) to the interior of the bench 35. Any air inlet 34 that is not in use may be plugged to prevent any undesired outflow of air (i.e., out of the bench 35) therethrough. The bench 35 may include a diffusor manifold 28 located at the top of the rear wall 76 of the bench 35, and fluidly connected to the interior of the bench 35. The diffusor manifold 28 fluidly connects the interior of the bench 35 to a diffusor 40 disposed at the front top portion of the back support wall 19. The diffusor manifold 28 also redirects air (i.e., heated, cooled, and/or ambient air) such that it exits the bench 35 via the diffusor 40 in a forward direction (that is, in the direction a person is facing when seated on the bench 35).

Still referring to FIG. 4, the bench 35 may include a plurality of temperature-controlled equipment rods 26 or structures (referred to hereinafter as "hot hats" 26). The hot hats 26 may be used to hang equipment on such as helmets, goalie gloves, articles of clothing, sporting equipment, recreational equipment, tooling, and other items. In some embodiments, the hot hats 26 include internal resistive or inductive heating elements to provide heat to items placed thereupon. In some embodiments, each of the hot hats 26 includes a peltier device such that it may be used for both heating and cooling. In some embodiments, the hot hats 26 (i.e., each hot hat 26 of the plurality of hot hats 26) extend vertically from the top of the diffusor manifold 28 and diffusor 40, and include a stem portion 44 coupled to a rounded knob 38 on top (both shown in FIG. 5), the rounded knob 38 being used to facilitate items being hung thereupon. In some embodiments, each of the hot hats 26 includes a hollow stem portion 44 that is used as a fluid conduit for delivering heated, ambient, and/or cooled air to the rounded knob 38 where it is discharged to the helmet/equipment/article of clothing and/or other item (i.e., to warm, dry, cool, etc. that item, piece of clothing, equipment).

Figure 5:
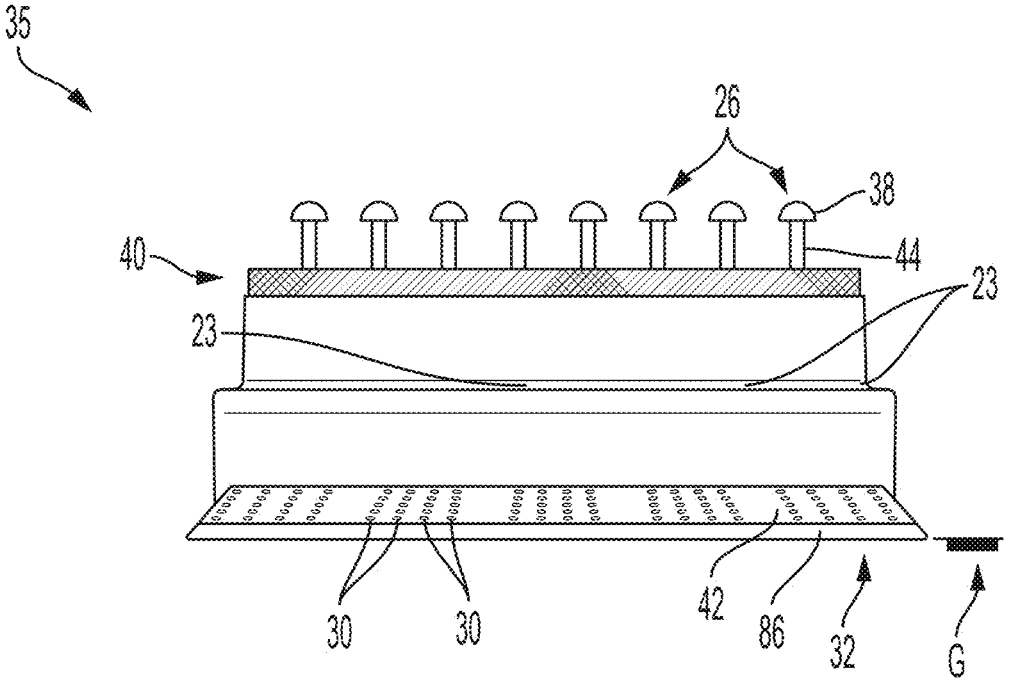
FIG. 5 illustrates a front view of a climate controlled bench, according to the present embodiments.

FIG. 5 illustrates a front view of a climate controlled bench 35 including the plurality of hot hats 26 (each including a stem portion 44 and rounded knob 38), seat perforations 23, a foot deck 32 that includes an edge portion 86 and plurality of perforations 30 disposed in a top surface 42 of the foot deck 32, and the diffusor 40, according to the present embodiments. The diffusor 40 may include a plurality of louvers (for example, articulatable louvers) a grate, screen, and/or other structure that allows air to pass therethrough while also helping to direct the airflow in a forward direction. In operation, the diffusor 40 directs air forward at approximately shoulder level such that it may be directed at the top of the shoulders and/or bottom of the neck of a person sitting on the bench 35, thereby providing effective cooling and/or heating (i.e., to areas of the body near the head that are likely to be at least partially exposed).

Figure 6:
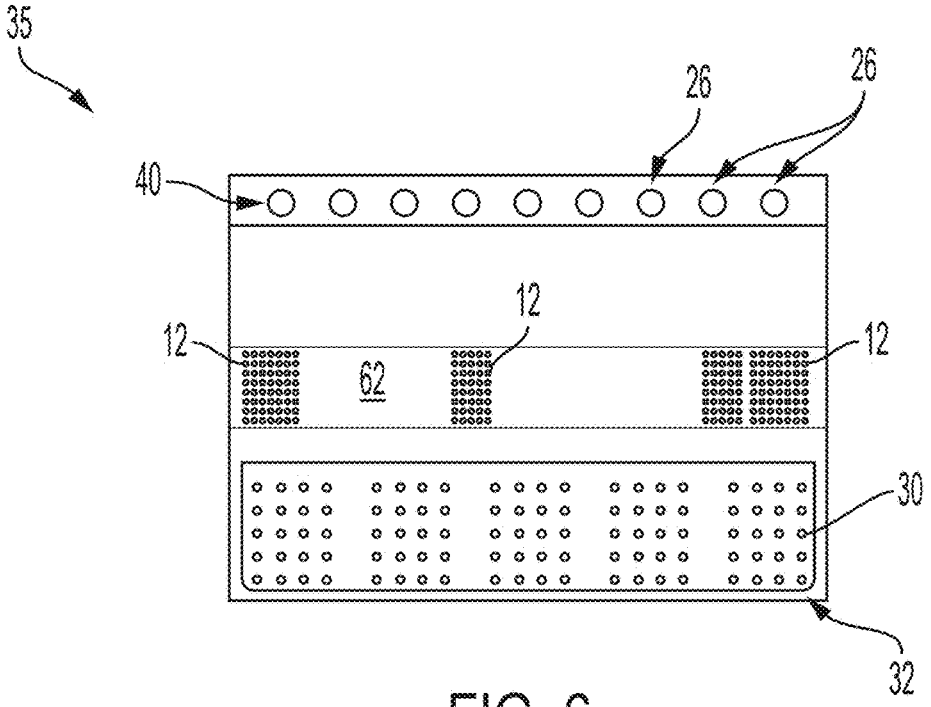
FIG. 6 illustrates a top view of a climate controlled bench, according to the present embodiments.

FIG. 6 illustrates a top view of a climate controlled bench 35 including the plurality of hot hats 26, the perforations 12 disposed within the seat portion 62, the diffusor 40, as well as the perforations 30 disposed within the foot deck 32, according to the present embodiments. As shown in FIG. 6, in some embodiments, the bench 35 may include clusters of perforations 12 disposed within the seat portion 62 such that there are spaces in between the clusters to allow users to sit in areas of the bench 35 where there are no perforations 12 in the seat portion 62.

Figure 7:
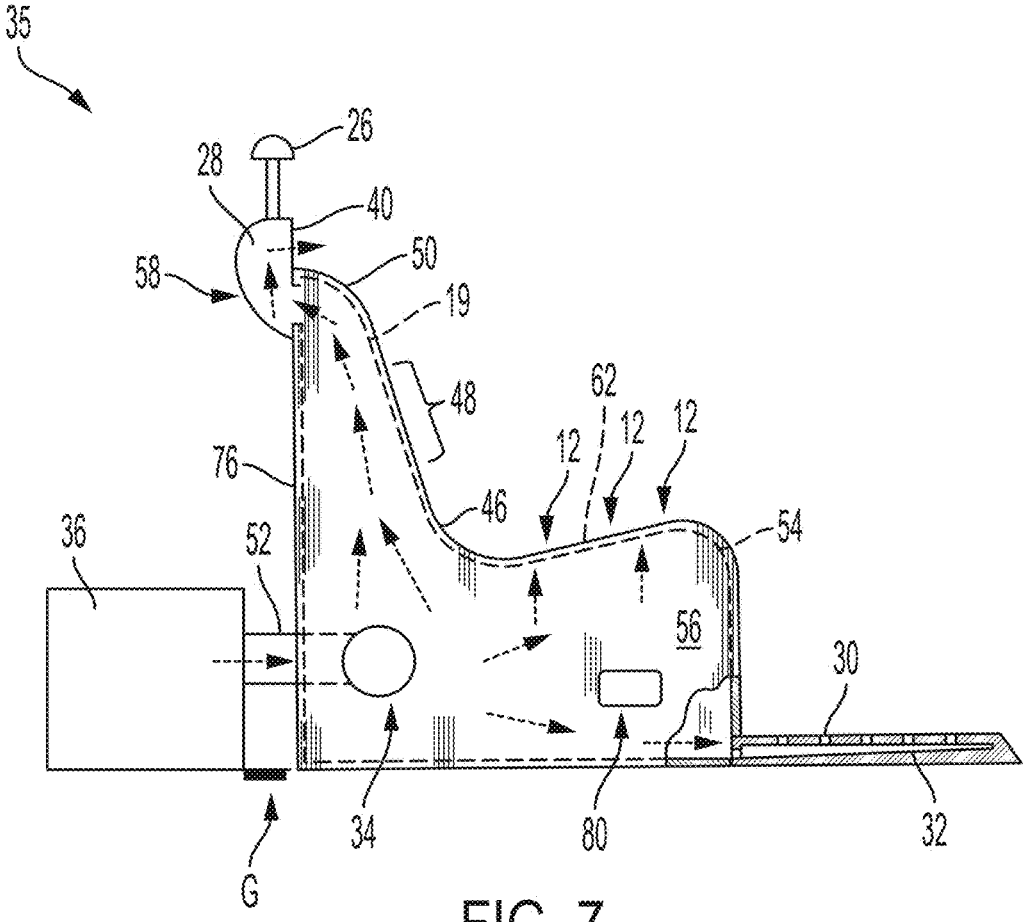
FIG. 7 illustrates a side view of a climate controlled bench, according to the present embodiments.

FIG. 7 illustrates a side view of a climate controlled bench 35 including the plurality of hot hats 26, the perforations 12 disposed within the seat portion 62, the diffusor 40, as well as the perforations 30 disposed within the foot deck 32, according to the present embodiments. As shown in FIG. 7, the bench 35 may include a heating, ventilation and air-conditioning (HVAC) unit 36 that is external to the bench 35 (for example, located behind or adjacent to the bench 35) such that it may provide heated, cooled, and/or ambient air to the air inlets 34 (shown in FIG. 4) via one or more ducts 52, which is/are connected between the HVAC unit 36 and the air inlet(s) 34. In some embodiments, the HVAC unit 36 may be located external to the bench 35 structure while in some embodiments, the HVAC unit 36 may be located within the bench 35. In some embodiments, the HVAC unit 36 may include an electric heater (such as a resistive heater and/or an inductive heater). In some embodiments, the HVAC unit 36 runs off of a 120-volt power source, a 208/230 volt 3-phrase power source, and/or off of other suitable voltage range power sources. In some embodiments, the HVAC unit 36 includes a gas heater. In some embodiments, the HVAC unit 36 includes an air-conditioning (AC) unit for cooling the air. In some embodiments, the HVAC unit 36 includes both an AC unit and a gas heater. In some embodiments, the HVAC unit 36 includes both an AC unit and an electric heater. In some embodiments, the HVAC unit 36 includes a blower for moving cooled, heated, and/or ambient air out of the HVAC unit 36 for circulation within the bench 35. In some embodiments, the HVAC unit 36 includes a mechanism for heating air and circulating air, but not for cooling air. In some embodiments, the HVAC unit 36 includes a mechanism for cooling air and circulating air, but not for heating air. In some embodiments, the HVAC unit 36 may be controlled via a local controller. In some embodiments, the HVAC unit 36 includes a control unit that is coupled to a wireless interface such that the HVAC unit 36 may be controlled remotely. In some embodiments, the HVAC unit 36 may include an AC unit that is water cooled in a closed loop configuration. In some embodiments, the HVAC unit 36 may include an AC unit that is water cooled in an open loop configuration.

Referring still to FIG. 7, in some embodiments, the bench 35 includes a top contoured portion 50 disposed at the top of the back support wall 19. The top contoured portion 50 may be outwardly convex (i.e., the convex portion is on exterior of the bench 35 and the concave portion faces the interior of the bench 35). In some embodiments, the bench 35 includes a middle contoured portion 46 located at the bottom of the back support wall 19. In some embodiments, the middle contoured portion 46 may be outwardly concave (i.e., the concave portion is on exterior of the bench 35 and the convex portion faces the interior of the bench 35). In some embodiments, the bench 35 includes a front contoured portion 54 located at the front of the seat portion 62. In some embodiments, the front contoured portion 54 may be outwardly convex (i.e., the convex portion is on exterior of the bench 35 and the concave portion faces the interior of the bench 35). The middle contoured portion 46 may form the transition between the back support wall 19 and the seat portion 62 of the bench 35. In some embodiments, the back support wall 19 includes a substantially linear portion 48 disposed between the top contoured portion 50 and the middle contoured portion 46. In some embodiments, the substantially linear portion 48 is oriented at an angle of about 19 degrees (for example, from about 18 degrees to about 20 degrees, or from about 17 degrees to about 21 degrees, or from about 15 degrees to about 23 degrees) relative to the vertical plane (i.e., relative to the bench rear wall 76).

Still referring to FIG. 7, the approximate paths that air follows through the bench to the diffusor 40, and out the perforations 30 in the foot deck 32, and/or out the perforations 12 in the seat portion 62 are illustrated via dotted arrows. For example, in the case of air that exits the bench 35 via the diffusor 40, after exiting the air inlet 34, air flows within a passageway formed by the bench rear wall 76 (which is vertically oriented) and the back support wall 19. The passageway narrows as it forms the top of the bench 35, where it flows into the diffusor manifold 28, which includes a contoured rear wall 58. Each of the contoured rear wall 58 of the manifold 28 and the top contoured portion 50 guide and redirect the air into the manifold 28, and then out through the diffusor. Accordingly, the exterior frame or structure of the bench 35 acts as a conduit for routing air to the diffusor manifold 28 such that no other manifold, ducting, plenum, etc. within the interior of the bench 35 is used to deliver air from the inlet 34 to the diffusor manifold 28. Stated otherwise, the substantially hollow shell 56 that provides the overall structure of the bench 35 is contoured such that it (and it alone) acts as a fluid conduit to deliver air from the air inlet 34 to the diffusor manifold 28. No other internal ducts, structures, plenums, or conduits other than the hollow shell 56 itself are needed to direct air from the air inlet 34 to the diffusor manifold 28. In order to maximize the airflow to the diffusor manifold 28 and diffusor 40, the bench 35 illustrated in FIGS. 4-7 does not include perforations in the back support wall 19. In some embodiments, the bench 35 illustrated in FIGS. 4-7 may include one or more retractable trays 3 (as shown in FIGS. 1 and 2). According to aspects of the present disclosure, various features and aspects of the bench embodiments illustrated in FIGS. 1-3 are applicable to the embodiments illustrated in FIGS. 4-7 and vice versa.

Figure 8A:
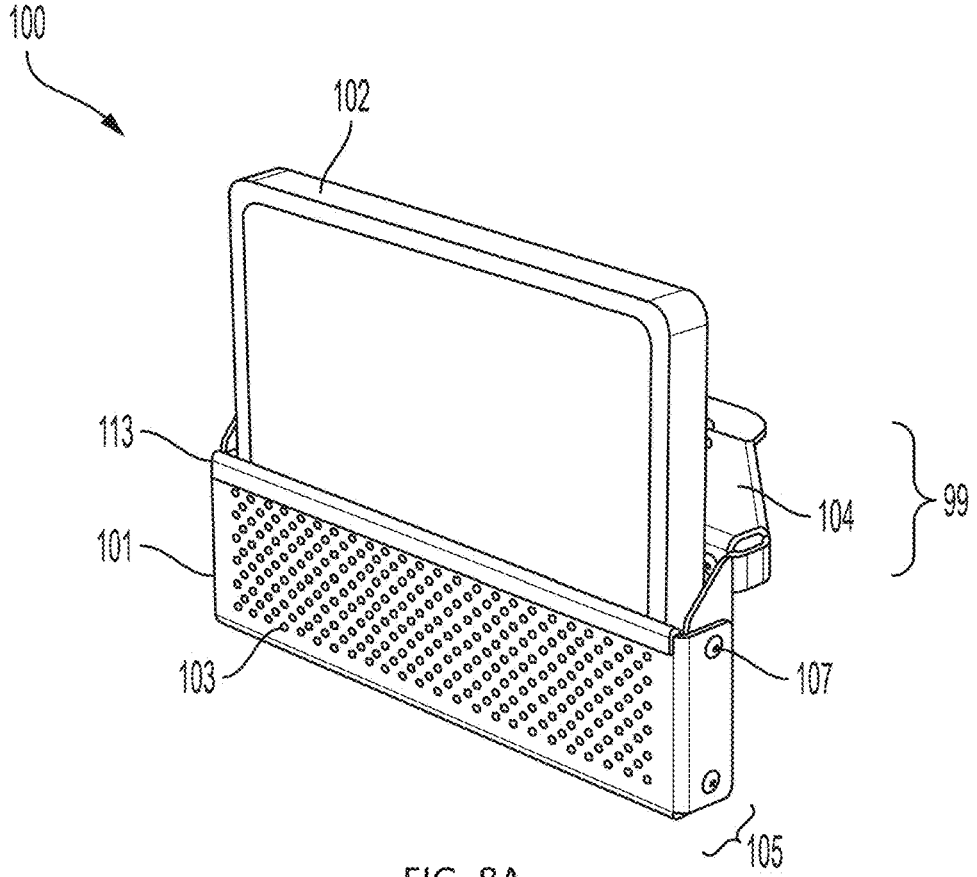
FIG. 8A illustrates a perspective front view of a tablet holder that may be used in connection with the climate controlled bench, according to the present embodiments.
Figure 8B:
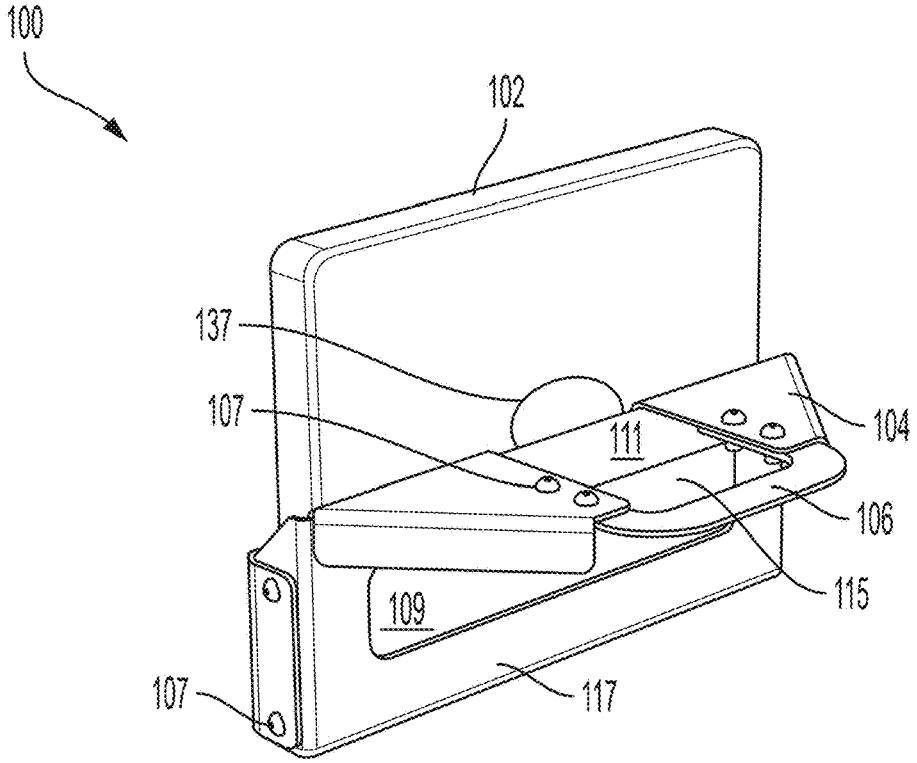
FIG. 8B illustrates a perspective rear view of a tablet holder that may be used in connection with the climate controlled bench, according to the present embodiments.

FIGS. 8A and 8B illustrate perspective front and rear views of a tablet holder 100 that may be used in connection with the climate controlled bench described herein. As shown in FIGS. 8A and 8B, the tablet holder 100 is sized such that a tablet 102 (for example, an electronic tablet 102 such as an Apple iPad, Kindle, Kindle Scribe, Apple iPad Mini, Amazon Fire, Android Tablet, Samsung Galaxy Tab, iPad Pro, Kindle Paperwhite, as well as other types of tablets) may sit within it. The tablet holder 100 may generally include a pocket portion 105 and an attachment assembly 99. The pocket portion 105 is sized such that the thickness of the tablet 102 may fit therewithin, allowing for some additional space to account for a protective case surrounding the tablet 102. The pocket portion 105 is further sized such that the width of the pocket portion 105 accommodates a height (or length) dimension of the tablet 102 (again allowing for the dimensions of a protective case). The pocket portion 105 is further sized such that a height of the pocket portion 105 extends for at least a certain percent of a width dimension of the tablet 102 (for example, from about 20% to about 70%, from about 20% to about 60%, from about 30% to about 70%, from about 20% to about 50%, from about 30% to about 70%, from about 30% to about 60%, and/or from about 30% to about 50% of the width dimension of the tablet 102 (and/or other suitable ranges or sub-ranges therebetween)). For example, in some embodiments, the tablet holder 100 may include outer thickness dimensions in a range from 0.5 inches to about 2 inches thick (for example, from about 0.75 to about 1.75 inches, from about 0.5 inches to about 1.5 inches, from about 0.5 inches to about 1.75 inches, from about 0.75 inches to about 1.5 inches, from about 1.0 inches to about 1.75 inches, from about 0.5 inches to about 1.25 inches, from about 0.5 inches to about 2.5 inches, from about 0.75 inches to about 2.5 inches, from about 1.25 inches to about 2.25 inches thick, and or other suitable sub-ranges therebetween).

Referring still to FIGS. 8A and 8B, and also to Table 1 below, dimensions for various tablet models can vary, as shown in Table 1. While tablet height and width dimensions can vary by several inches, modern tablet thickness vary by only about 0.1 to 0.15 inches. In addition, protective tablet cases tend to add about 0.15 to about 0.35 inches to the thickness of the tablet, and from about 0.3 to about 0.5 inches to the height and the width of the tablet. Accordingly, the interior thickness of the pocket portion 105 may be controlled within a narrow range (for example, from about 0.5 inches to about 1.0 inches), thereby allowing tablets 102 of all sizes to fit snugly therewithin, and also minimizing the chances that the tablet 102 will fall out of (or be knocked out of) the tablet holder 100. For example, in some embodiments, the interior thickness of the pocket portion 105 may be in a range from about 0.5 inches to about 1.0 inches, from about 0.5 inches to about 0.9 inches, from about 0.5 inches to about 0.8 inches, from about 0.5 inches to about 0.75 inches, from about 0.5 inches to 0.7 inches, from about 0.55 inches to about 0.85 inches, from about 0.6 inches to about 0.9 inches, from about 0.6 inches to about 0.85 inches, from about 0.6 inches to about 0.75 inches, and/or other sub-ranges therebetween. In some embodiments, the pocket portion 105 may include a height in a range from about 2.0 inches to about 5.0 inches, from about 2.0 inches to about 4.0 inches, from about 2.0 inches to about 3.5 inches, from about 2.5 inches to about 5.0 inches, from about 2.5 inches to about 4.5 inches, from about 2.0 inches to about 4.5 inches, from about 2.0 inches to about 6.0 inches, and/or other suitable subranges therebetween. In some embodiments, the pocket portion 105 may include a width that accommodates the largest dimension of a tablet 100, taking the protective casing into account. For example, in some embodiments, the pocket portion 105 may include a width in a range from about 8.0 inches to about 12.0 inches, from about 9.0 inches to about 12.0 inches, from about 10.0 inches to about 12.0 inches, from about 10.5 inches to about 12.0 inches, from about 8.0 inches to about 11.5 inches, from about 10.5 inches to about 11.5 inches, and/or other suitable subranges therebetween.

TABLE 1

Common Tablet Models and Dimensions, in inches

| Tablet Model | Thickness | Height | Width |
|---|---|---|---|
| iPad | 0.30 | 9.87 | 6.85 |
| iPad with case | 0.63 | 10.30 | 7.29 |
| Kindle | 0.32 | 6.21 | 4.28 |
| Kindle Paperwhite | 0.32 | 6.90 | 4.90 |
| iPad Mini (Gen 1) | 0.28 | 7.87 | 5.30 |
| iPad Mini (Gen 6) | 0.25 | 7.69 | 5.30 |
| Amazon Fire | 0.36 | 9.72 | 6.54 |
| Samsung Galaxy Tab 7.7 | 0.30 | 7.70 | 7.00 |
| Samsung Galaxy Tab 10.1 | 0.30 | 9.70 | 10.10 |
| Kindle Scribe | 0.22 | 9.00 | 7.70 |
| iPad Pro | 0.25 | 11.04 | 8.46 |

Still referring to FIGS. 8A and 8B, the pocket portion 105 may include a front surface 101 with an array or air holes 103 disposed therein, as well as a rear surface 117 with an elongated gap 109 disposed therein. The array of air holes 103 and elongated gap 109 enable the tablet 102 to cool (through natural convection, or through forced convection via diffusor 40) when the tablet 102 is seated within the tablet holder 100. In addition, the array of air holes 103 and elongated gap 109 enable the tablet 102 to be warmed up (for example, on very cold days) when warm air is being discharged from the diffusor 40. The array of air holes 103 and elongated gap 109 also enable air from the diffusor 40 to pass through the pocket portion 105 (i.e., to a person sitting on the bench 35) when the tablet holder 100 is not holding a tablet. The attachment assembly 99 may include two angled side portions 104 connected via both a center portion 111 and an attachment member 106. The attachment assembly 99 may form a space 115 between the center portion 111 and the attachment member 106, thereby allowing the tablet holder 100 to be disposed around the stem portion 44 of the hot hat feature 26, as shown in FIG. 9B. Each of the components of the pocket portion 105 and the attachment assembly 99 may be attached via one or more fastening means 107 (for example, including, but not limited to: rivets, screws, nuts and bolts, snaps, welds, brazes, adhesives, washers, pins, clips, compression fits, and/or other suitable fastening or attachment means 107). While the pocket portion 105 may be oriented in a substantially vertical orientation when the tablet holder 100 is attached to the climate controlled bench 35, each of the components of the attachment assembly 99 may be oriented in a horizontal plane when the tablet holder 100 is attached to the climate controlled bench 35. For example, each of the two angled side portions 104, the center portion 111, and the attachment member 106 may be oriented in a plane that is perpendicular to the planes defined by the front and rear surfaces 101, 117 of the pocket portion 105. This arrangement allows the attachment assembly 99 to abut and/or rest flush on a top surface 119 of the bench 35 (shown in FIGS. 9A and 9B) while the pocket portion 105 rests flush against the front face of the diffusor 40. As used herein, the term "substantially perpendicular" means 90 degrees+/−3 degrees.

Figure 9A:
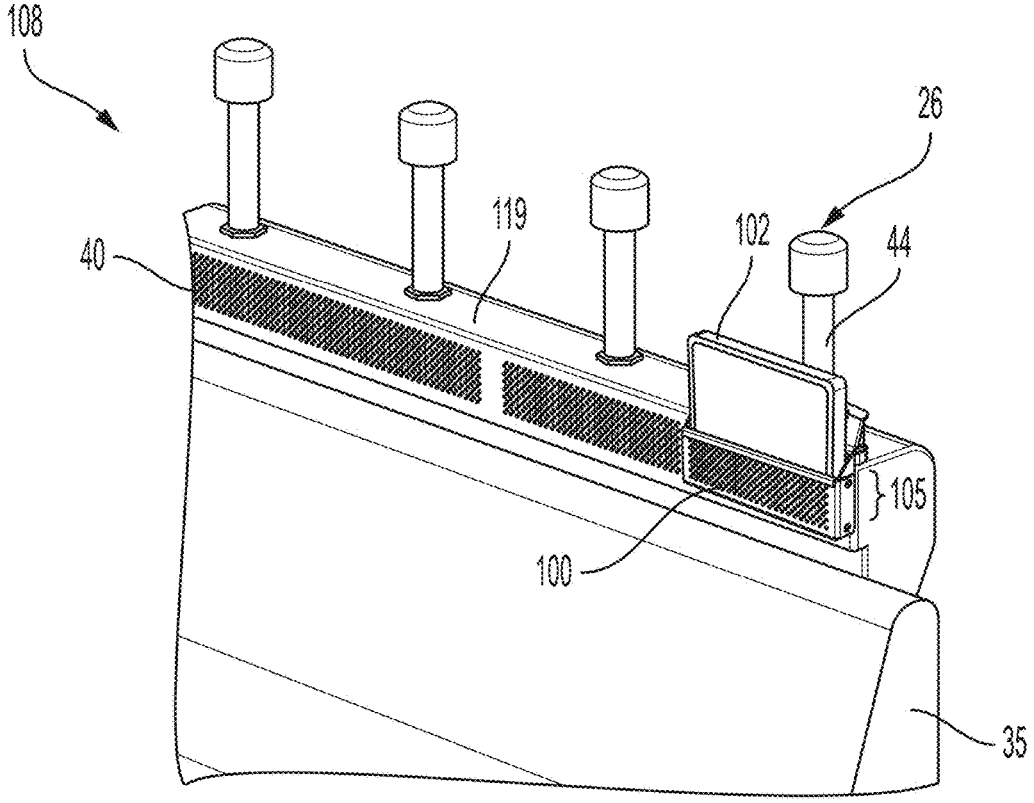
FIG. 9A illustrates a perspective front view of a tablet holder attached to a climate controlled bench, according to the present embodiments.
Figure 9B:
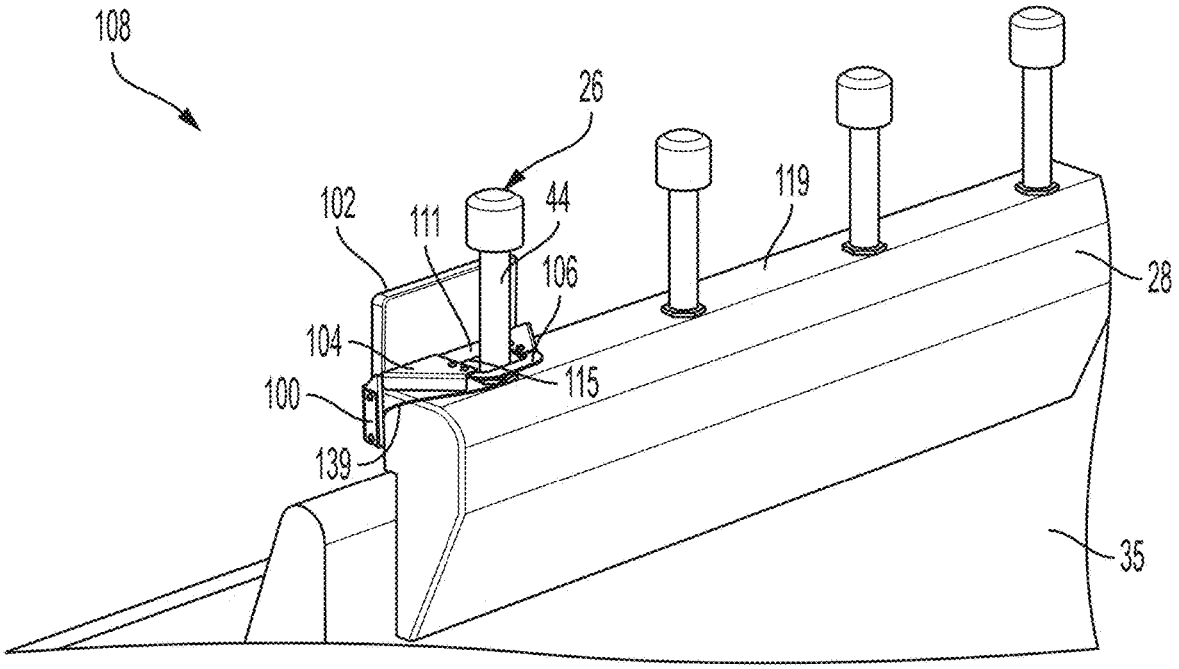
FIG. 9B illustrates a perspective rear view of a tablet holder attached to a climate controlled bench, according to the present embodiments.

FIGS. 9A and 9B illustrate perspective front and rear views of the tablet holder 100 attached to a climate controlled bench 35, according to the present embodiments. As shown in FIGS. 9A and 9B, the pocket portion 105 of the tablet holder 100 is vertically aligned when attached to the bench 35 such that the tablet 102 can sit within the tablet holder 100 (for example, within the pocket portion), in connection with gravity, with no further means required to secure the tablet 102 within the tablet holder 100. Each of the hot hats 26 (specifically, the stem portion 44 of each hot hat 26) may be inserted into the top surface 119 of the bench 35 through the space 115 defined between the attachment member 106 and the center portion 111, thereby securing the tablet holder 100 to the bench 35, as shown in FIG. 9B. In some embodiments, the stem portion 44 may be easily inserted into, and removed from, the bench 35 via a male-female connection, thereby enabling easy attachment of the tablet holder 100 to the bench 35 (via the stem portion 44). The diffusor manifold 28 is also visible in FIG. 9B.

In some embodiments, the tablet holder 100 includes an integrated wireless charging module 137 (shown in FIG. 8B) and/or an integrated charging cord 139 (for example, a USB charging cord, shown in FIG. 9B) to enable charging of the tablet 100. In some embodiments, the wireless charging module 137 includes a polymer housing or casing that is adhered to an internal vertical surface of the tablet holder 100. In some embodiments, the charging cord 137 and/or wireless charging module are electrically coupled to a power source external to the bench 35, and/or in some embodiments, internal to the hollow interior of the bench 35 (for example, via the stem portion 44 of one or more hot hats 26). In some embodiments, the tablet holder 100 is composed of a metallic material such as aluminum. In some embodiments, the tablet holder 100 may be adhered directly to the bench 35 (for example, a front, rear, and/or side surface of the bench) via one or more epoxies and/or other suitable adhesive.

Figure 10:
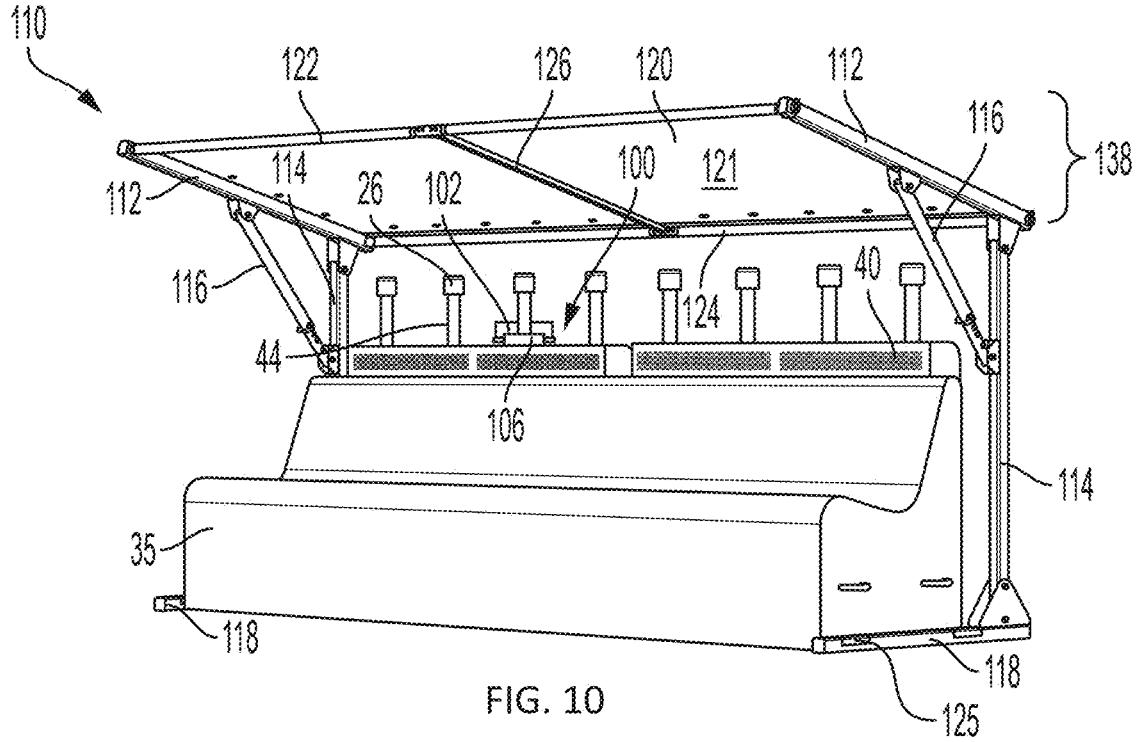
FIG. 10 illustrates a perspective front view of a climate controlled bench and a retractable shade that may be used in connection with climate controlled bench, according to the present embodiments.
Figure 11:
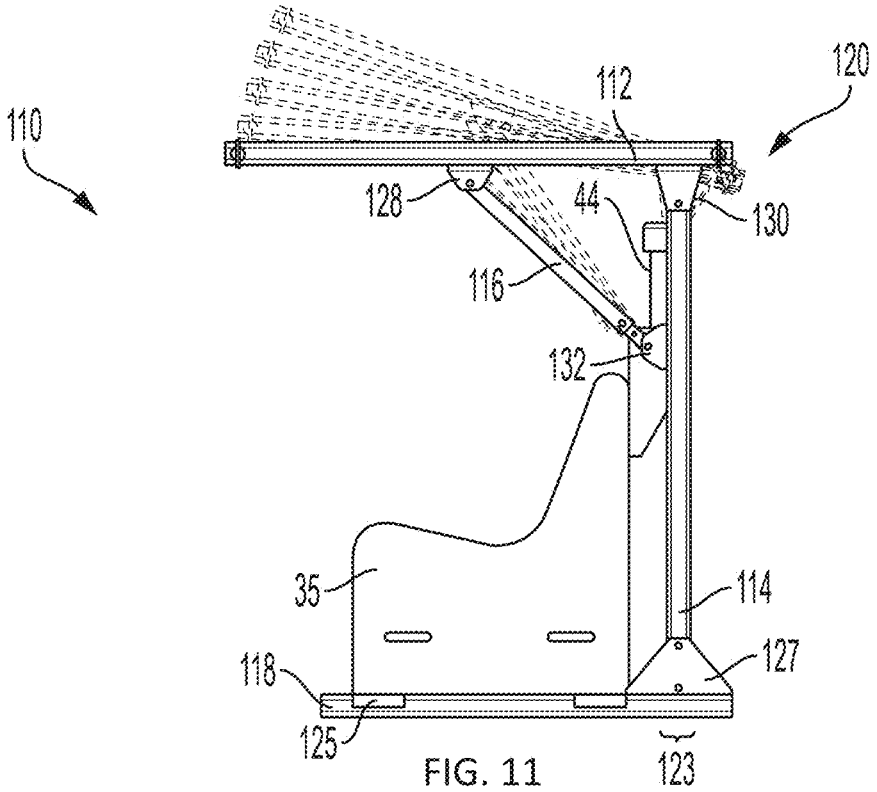
FIG. 11 illustrates a side view of a climate controlled bench and a retractable shade that may be used in connection with climate controlled bench, according to the present embodiments.

FIG. 10 illustrates a perspective front view of a system 110 including the climate controlled bench 35, the tablet 102 in the tablet holder 100, and a retractable shade 120 that may be used in connection with climate controlled bench 35, according to the present embodiments. FIG. 11 illustrates a side view of the system 110 shown in FIG. 10 (i.e., including the climate controlled bench 35 and a retractable shade 112). As shown in FIG. 10, the tablet holder 100 may be raised up with the attachment member 106 disposed around the stem portion 44 such that the tablet holder 100 is rotatable about the stem portion 44, thereby allowing the tablet 102 and tablet holder 100 to be positioned on an opposite (i.e., the rear side) of the bench 35, and further allowing the diffusor 40 to discharge heated or cooled air in a substantially unhindered fashion. Therefore, the tablet holder 100 and tablet 102 disposed therein provide a method of controlling a localized air flow (i.e., at a portion of the diffusor 40). When the tablet holder 100, with a tablet 102 sitting therewithin, is positioned in front of the diffusor 40, the obstruction to the airflow will be maximized and the airflow in that localized area will be minimized. By removing the tablet 102 from the tablet holder 100, airflow in the localized area will be increased because additional air will be able to pass through the array or air holes 103 and elongated gap 109 of the tablet holder 100. Airflow can then be further increased to a maximum localized airflow by raising and rotating (and then lowering) the tablet holder 102 such that it is positioned at the rear of the bench 35, thereby removing it as an obstruction to the diffusor, as described herein, and maximizing the localized airflow (and associated heating/cooling effect).

Referring still to FIGS. 10 and 11, the system 110 may include a retractable shade 112 including multiple vertical members 114, a flexible shade 121 (i.e., supported by two side members 112, a front member 122, and a rear member 124), two telescoping supports 116 extending between the vertical members 114 and the side members 112, a center support member 126 extending between the front support member 122 and the rear support member 124, two foot supports 118 that interface with anchoring clips 125 attached to the bench 35, a first rotatable support 130 rotatably coupling the each vertical member 114 to the corresponding side member 112, a second rotatable support 132 rotatably coupling a bottom end of each telescoping support 116 to the corresponding vertical support, and a third rotatable support 128 rotatably coupling a top end of each telescoping support 116 to the corresponding side member 112. The retractable shade 120 may further include a foot bracket 127 fixedly connecting each foot support 118 to the corresponding vertical member 114. In some embodiments, the retractable shade 120 include an offset 123 between the center of rotation of the second rotatable support 132 and a centerline of the corresponding vertical member 114, as well as an offset between a center of rotation of the third rotatable support 128 and the centerline of the corresponding side member 112, such that the shade portion 138 of the retractable shade 120 may be rotated to a fully vertical position behind the bench 35 when shading is not needed.

Still referring to FIGS. 10 and 11, the system 110 may include a spring-loaded roller in either or both of the side members 112 such that the flexible shade 121 may be rolled up (i.e., wound around the spring-loaded roller) when not in use. The flexible shade 121 may be made of a material that does not let light through (i.e., it may be opaque), allows some amount of air through (i.e., it may be "breathable"), and is at least partially waterproof or water resistance such as Gore-Tex® (i.e., expanded polytetrafluoroethylene (ePTFE)), canvas, polyester, nylon, linen, and/or other breathable materials, which reduce the tendency of the flexible shade to act like a sail (i.e., during weather conditions that include strong winds). In some embodiments, the retractable shade 120 includes a total width to approximately match that of the climate controlled benches 20, 35 described herein (for example, in a range from about 30 inches to about 200 inches, or in some cases about 2-4 inches wider such that the foot portions 118 may be positioned such that they are positioned outside of, yet still abutting, the side walls of the bench 20, 35).

Figure 12:
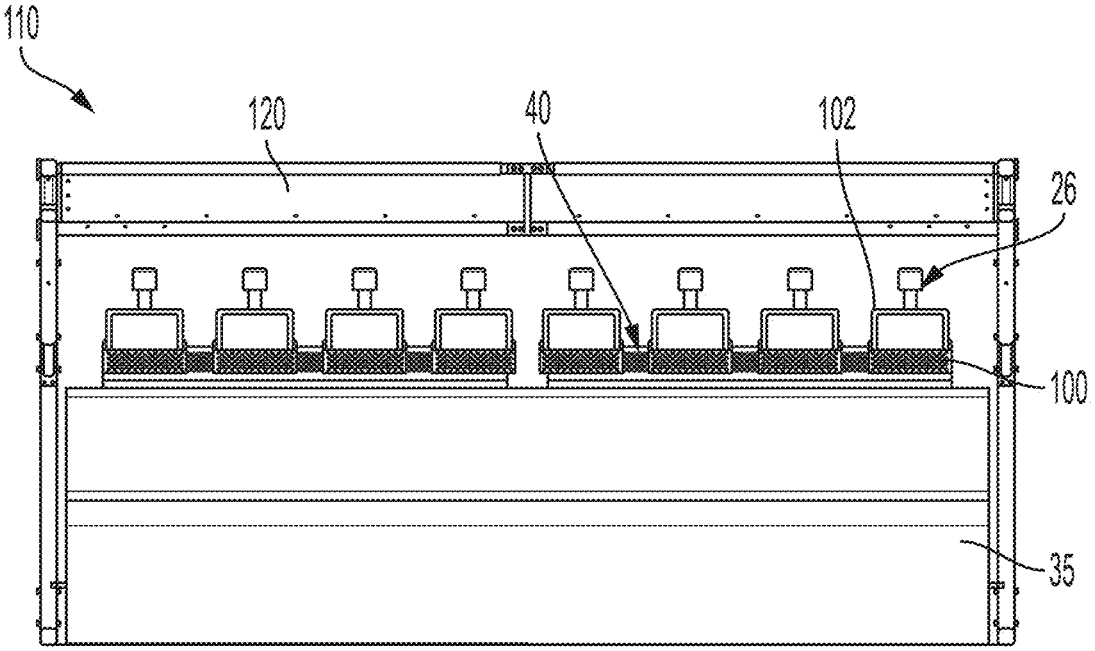
FIG. 12 illustrates a front view of the climate controlled bench and the retractable shade, with multiple tablet holders attached to the climate controlled bench, according to the present embodiments.
Figure 13:
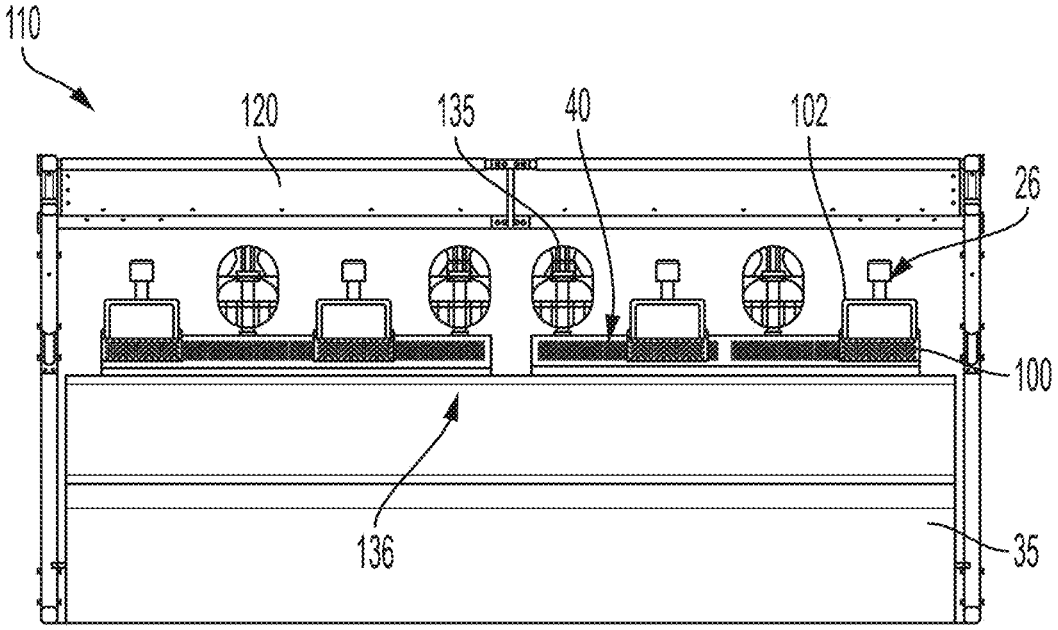
FIG. 13 illustrates a front view of the climate controlled bench and the retractable shade, with multiple tablet holders attached to the climate controlled bench, according to the present embodiments.

FIGS. 12 and 13 illustrate front views of the system 110 including the climate controlled bench 35, tablet holder 100, tablet 102, and retractable shade 120, according to the present embodiments. FIG. 13 further illustrates multiple helmets 135 positioned on hot hats 26, according to the present embodiments. In one instance 136, a helmet 135 is positioned on the same hot hat 26 that a tablet holder 100 and table 102 are attached to. The diffusor 40 is also visible in FIGS. 12 and 13. The tablet holder 100 and sunshade 120 described herein may be used in connection with the climate-controlled benches described herein, including the benches depicted in FIGS. 1-7. In addition, the features described in FIGS. 1-7 are also applicable to the embodiments depicted in FIGS. 8A-13.

Figure 14:
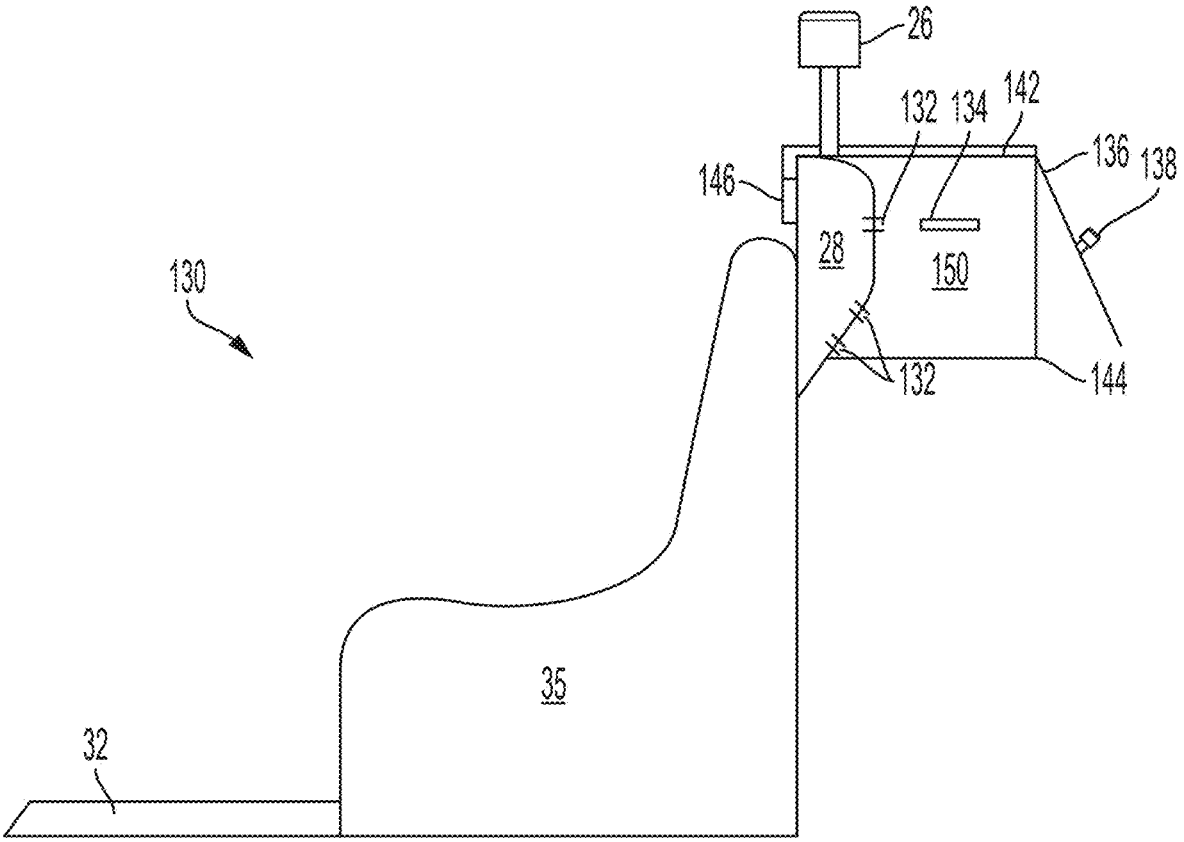
FIG. 14 illustrates a side view of a system including the climate controlled bench and a helmet heater box, according to the present embodiments.

FIG. 14 illustrates a side view of a system 130 including the climate controlled bench and a helmet heater box 150, according to the present embodiments. As shown in FIG. 14, the system 130 may include the bench 35, the foot deck 32, at least one hot hat 26, the diffusor manifold 28, and the heater box 150. The heater box 150 may be used to store helmets, electronics, and/or other items that require heating (or in some cases, cooling). For example, modern football helmets often include electronics such as communications equipment so that play callers can communicate plays to players on the field (such as quarterbacks and middle linebackers) during the game. In some cases, those electronics are ideally maintained at or around room temperature, in order to function optimally. Accordingly, on really cold days, the heater box 150 may be used to provide more consistent and comprehensive heating to helmets that include electronics equipment (i.e., as compared to the heating available via only the hot hats 26). In addition, on really hot days, the heater box 150 may provide cooling to helmets and/or other electronic components such as tablets and laptops.

Referring still to FIG. 14, in some embodiments, the heater box 150 may be mounted on top of the bench 35 (for example, via multiple support members 142 and multiple brackets 146, which are used to "hang" the heater box 150 over the diffusor manifold 28 of the bench 35), in connection with gravity. Because the heater box 150 includes dimensions and geometry to match the rear surface of the diffusor manifold, the heater box 150 is prevented from rotating loose of the mounting via the multiple brackets 146 (which is the only way gravity could cause the heater box 150 from falling off). For example, surfaces (or rear walls/rear planes) 154 and 172 of the heater box 150 match the dimensions and angles of diffusor manifold 28 rear surfaces 174 and 176, respectively (all shown in FIG. 17). Accordingly, it is noted that surface/rear wall/plane 154 of the heater box 150 is non-orthogonal with the other exterior surfaces of the heater box 150 (and that the heater box 150 includes a pentagonal cross section across its lengthwise dimension). In some embodiments, the support members 142 and or brackets 146 may also be bolted or otherwise rigidly coupled to the top and/or front surfaces of the diffusor manifold 28. The heater box 150 may include a front door 136 configured to be rotated open via hinge 156 (shown in FIG. 16). The front door 136, which may also include a front handle 136 attached thereto, allows items to be placed within, and removed from, the heater box 150. The heater box 150 may further include one or more magnets 144 disposed along a bottom surface configured to be magnetically coupled to the front door 136, thereby keeping the door closed, and enabling heated and/or cooled air to remain within the heater box 150 when in use. In some embodiments, the front door 136 is composed of a magnetic material such as metal. In some embodiments, the front door 136 is composed of a non-magnetic material, but includes magnetic strips coupled thereto (i.e., on an interior surface at the bottom) to be magnetically coupled to the magnet(s) 144. The heater box 150 may further include one or more side handles 134 to facilitate carrying of the heater box 150.

Still referring to FIG. 14, the heater box 150 may be fluidly coupled to the bench 35 via one or more passages, apertures, openings, and/or conduits 132 disposed in a rear surface of the bench 35 (for example, in surface 174 and/or surface 176 (shown in FIG. 17)). In some embodiments, the apertures 132 are formed in the rear surface(s) of the bench 35 via one or more removable blanks 158 (shown in FIGS. 16 and 17) which may be used to fluidly connect or disconnect an interior of the bench 35 with/from an interior of the heater box 150. In some embodiments, corresponding apertures are disposed within rear surfaces 154 and 172 of the heater box 150. In some embodiments, the heater box 150 includes open planes 154 and 172 rather rear walls or solid surfaces, thereby allowing all air flowing through openings 132 to enter the interior of the heater box 150. In some embodiments, the heater box 150 may include a gasket or sealing member disposed around the peripheries of rear surfaces/rear planes 154 and/or 172 to fluidly seal the interface between the heater box 150 and bench 35. In some embodiments, the sealing member may include rubber, flexible polymers, and/or other suitable sealing materials. The sealing member may also serve to prevent or reduce fiberglass-on-fiberglass contact between the heater box 150 and bench 35, thereby reducing the likelihood that the two components will scratch or otherwise damage one another upon contact. In other embodiments in which the bench 35 and box 150 are composed of other materials, the sealing member helps to minimize surface-contact related damages in those instances as well. The system 130 illustrated in FIG. 14 enables the interior of the heater box 150 to be maintained at approximately the same temperature as the interior of the bench 35, without the need for a separate control unit that is dedicated to the heater box 150. Accordingly, on colder days when the bench is being heated, the heater box will also be heated, while on hot days when the bench is being cooled, the heater box will also be cooled.

Figure 15:
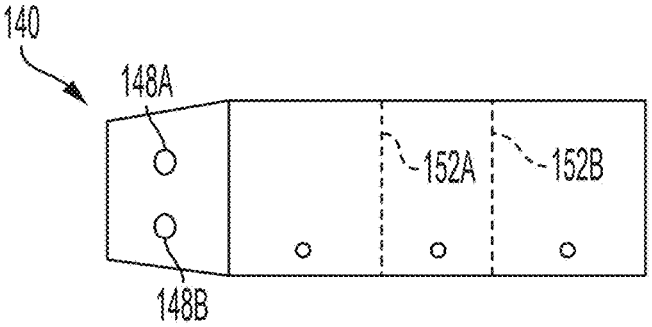
FIG. 15 illustrates a front perspective view of a helmet heater box, according to the present embodiments.

FIG. 15 illustrates a front perspective view of a helmet heater box 140, according to the present embodiments. The heater box 140 of FIG. 15 differs from the heater box 150 of FIG. 14 in that it is configured to be standalone, and to couple directly to a heating unit 7 (or HVAC unit 7) via one or more hose ports 148A, 148B. As such, the heater boxes 140, 150 of the present disclosure may be thermally coupled to a climate-controlled bench 35 and/or to a heating unit 7 (or HVAC unit 7). For example, in some embodiments, a heater box 140, 150 is not needed on a permanent basis, and as such, the standalone heater box 140 may be deployed on an as-needed basis. Dashed lines in FIG. 15 show the location of first and second dividing walls 152A, 152B within the interior of the heater box 140, 150.

Figure 16:
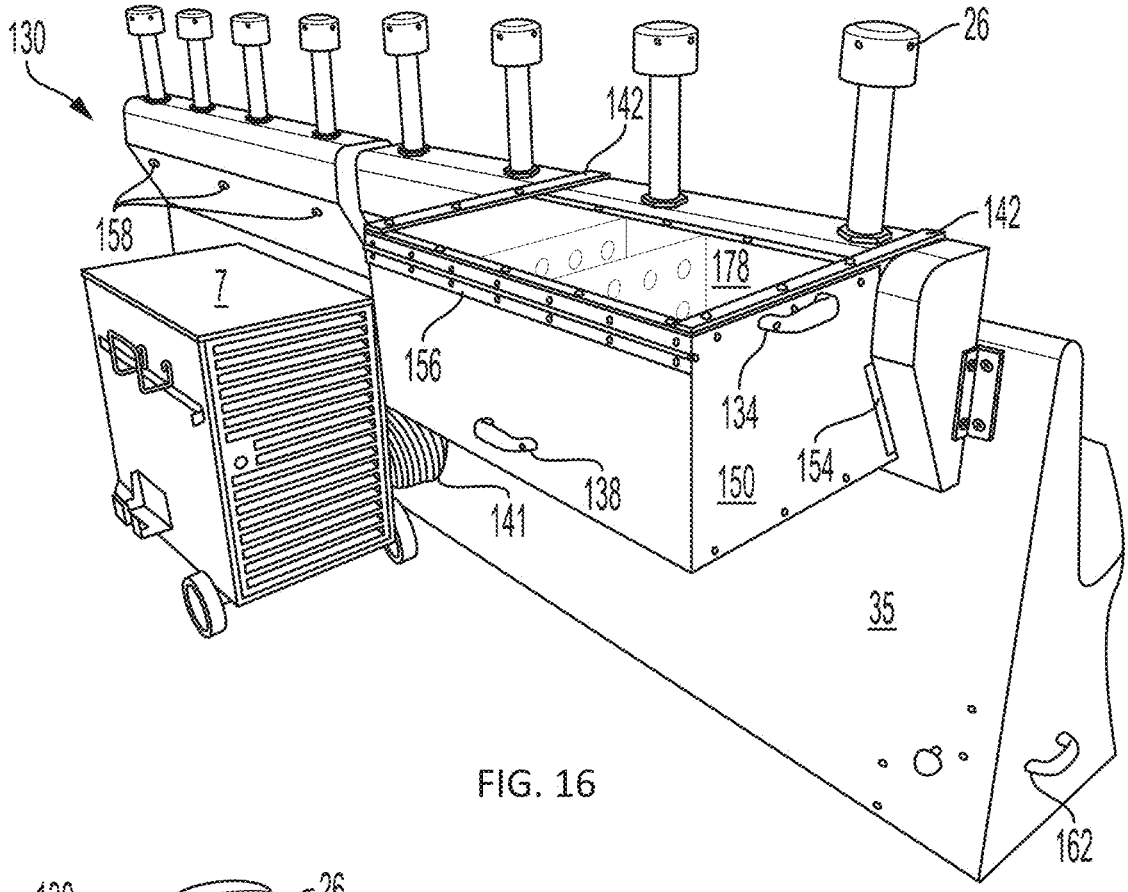
FIG. 16 illustrates a rear perspective view of a system including the climate controlled bench and a helmet heater box, according to the present embodiments.

FIG. 16 illustrates a rear perspective view of a system 130 including the climate controlled bench 35 and a helmet heater box 150, according to the present embodiments. As shown in FIG. 16, the system 130 may include the heater box 150 including the front handle 138, side handle 134, hinge 156, rear surface/plane 154, and support members 142. As shown in FIG. 16, the system may also include the heating unit 7 (or HVAC unit 7) and the bench 35 including multiple hot hats 26, and multiple removable blanks 158, as well as an end handle 162. In some embodiments, the top surface 178 of the heater box 150 may include a transparent (for example, plexiglass) surface 178 such that users can easily see what's inside the heater box 150 without having to bend down or open the heater box 150. In some embodiments, the system may include a coupling 141 (such as a flexible vent hose 141) fluidly coupling the heating unit 7 (or HVAC unit 7) to the bench 35 and/or to the heater box 150.

Figure 17:
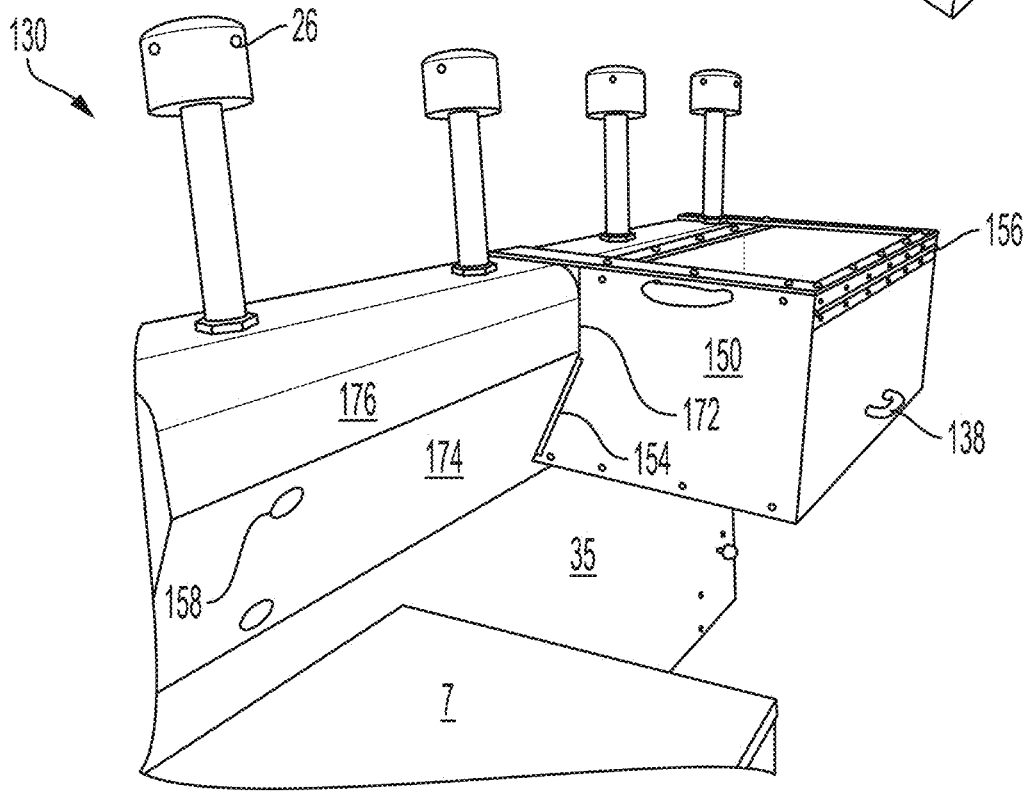
FIG. 17 illustrates a rear perspective view of a system including the climate controlled bench and a helmet heater box, according to the present embodiments.

FIG. 17 illustrates a rear perspective view of a system 130 including the climate controlled bench 35 and a helmet heater box 150, according to the present embodiments. As shown in FIG. 17, the system 130 may include the heater box 150 including the front handle 138, hinge 156, rear surfaces/planes 154 and 172, and other components as described herein. System 130 may also include the heating unit 7 (or HVAC unit 7), and bench 35 including multiple hot hats 26, at least one removable blank 158, and diffusor manifold rear surfaces 174, 176. In some embodiments, the helmet heater box 150 may include rubberized and/or polymerized layers or coatings disposed on exterior surfaces of rear surfaces/planes 154 and 172 so as to reduce the chances that exterior surfaces of the bench (i.e., rear surfaces of the bench, i.e., diffusor manifold rear surfaces 174, 176) are scratched, punctured and/or otherwise damaged.

Figure 18:
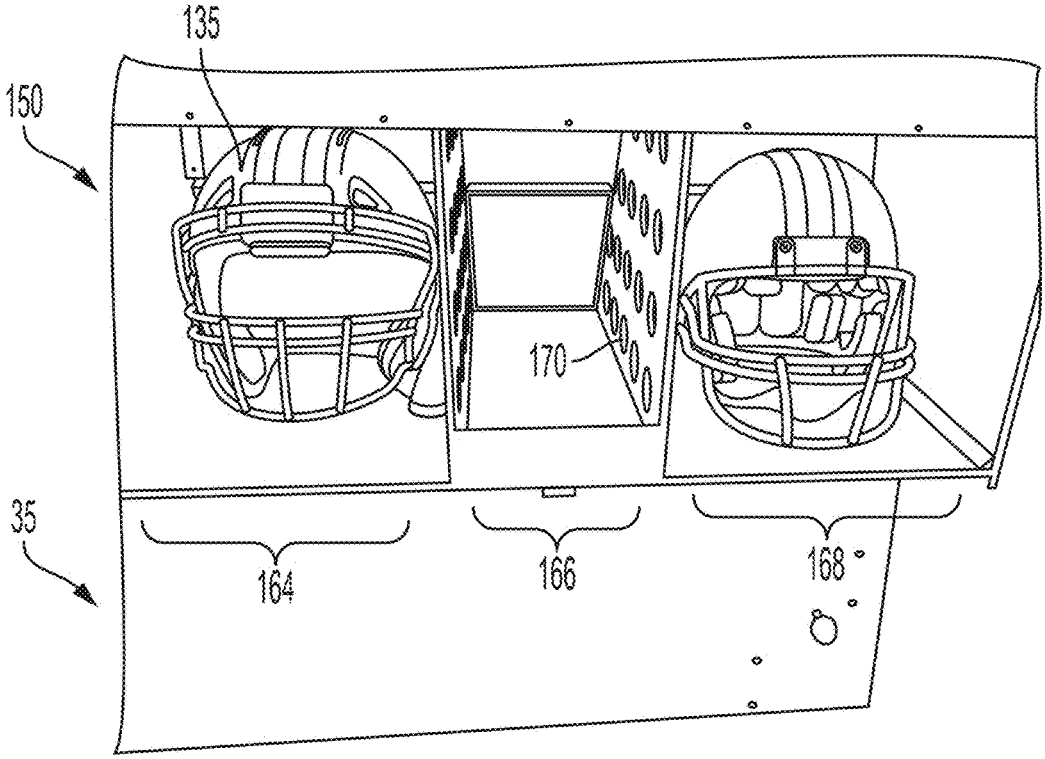
FIG. 18 illustrates front view of a helmet heater box, according to the present embodiments.
Figure 19:
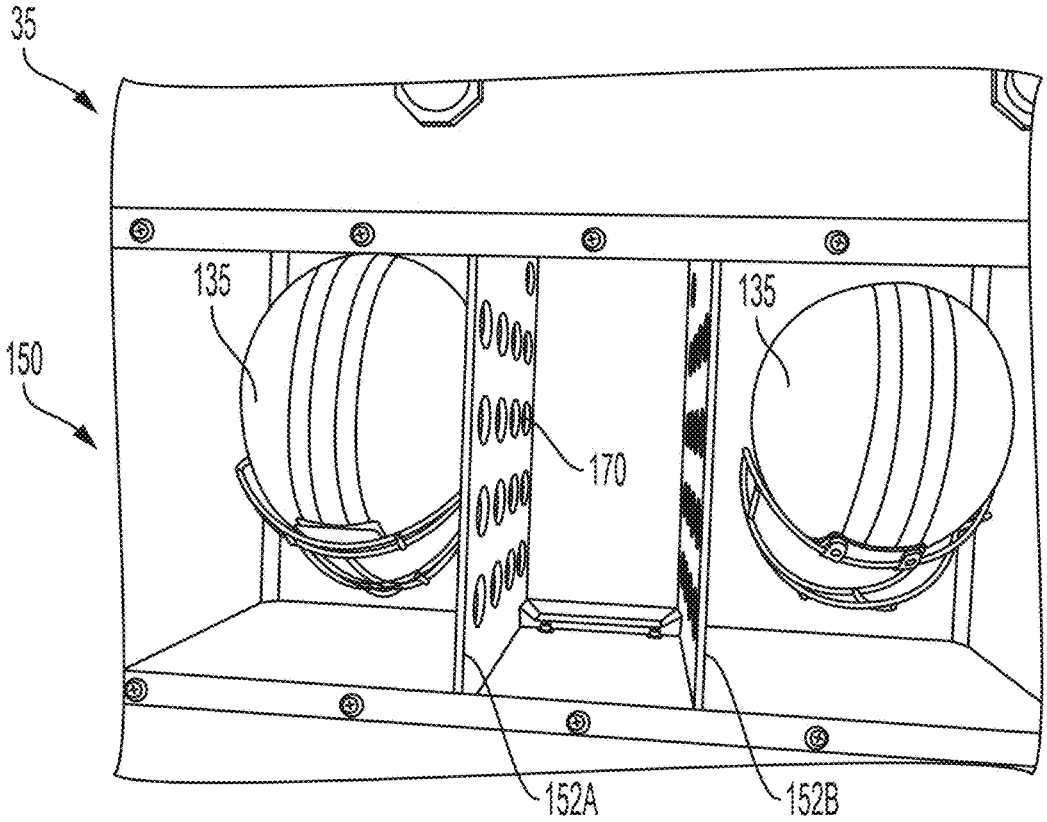
FIG. 19 illustrates top view of a helmet heater box, according to the present embodiments.

FIGS. 18 and 19 illustrate front and top views of the helmet heater box 150 and bench 35, according to the present embodiments. It is noted that FIG. 18 illustrates the heater box 35 with the front door 136 (shown in FIG. 14) raised while FIG. 19 illustrates the interior of the heater box 35 through the transparent top surface 178 (shown in FIG. 16). The heater box 150 may include a first compartment 164, a second compartment 166, and a third compartment 168 disposed within the interior. In some embodiments, at least two of the three compartments 164, 166, 168 are sized such that a full-size football helmet 135 may be place therewithin. At least one component (i.e., second compartment 166 in some embodiments), may be smaller than the other two components and may be used to house other items such as electronic devices, snacks, beverages, gloves, hats, towels, etc. Dividing walls 152A and 152B may define the boundaries of the first, second and/or third compartments 164, 166, 168. Each of the dividing walls 152A and 152B may include one or more cross-connects 170 (i.e., holes or apertures disposed within the respective dividing wall 152A, 152B), thereby ensuring a consistent and uniform temperature profile across the interior of the heater box 150. In some embodiments, heated or cooled air may be transferred from one or more of the hot hat 26 ports (disposed within the bench 35) to heater box 150 via tubing (for example, 1-inch, or 1.5-inch or 2-inch or 2.5-inch flex ducting. Those of skill in the art will understand that the heater box 140, 150 may be used in connection with other components described herein. In addition, those of skill in the art will understand that components and features described in connection with heater box 150 are generally applicable to heater box 140, and vice versa.

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

These and other features, aspects and advantages of the present invention will become better understood with reference to the following description and appended claims. The accompanying drawings, which are incorporated in and constitute a part of this specification, illustrate embodiments of the present disclosure and, together with the description, serve to explain the principles of the present embodiments.

Certain Definitions

In order for the present disclosure to be more readily understood, certain terms are first defined below. Additional definitions for the following terms and other terms are set forth throughout the specification.

An apparatus, system, composition, or method described herein as "comprising" one or more named elements or steps is open-ended, meaning that the named elements or steps are essential, but other elements or steps may be added within the scope of the composition or method. To avoid prolixity, it is also understood that any apparatus, composition, or method described as "comprising" (or which "comprises") one or more named elements or steps also describes the corresponding, more limited composition or method "consisting essentially of" (or which "consists essentially of") the same named elements or steps, meaning that the composition or method includes the named essential elements or steps and may also include additional elements or steps that do not materially affect the basic and novel characteristic(s) of the composition or method. It is also understood that any apparatus, composition, or method described herein as "comprising" or "consisting essentially of" one or more named elements or steps also describes the corresponding, more limited, and closed-ended composition or method "consisting of" (or "consists of") the named elements or steps to the exclusion of any other unnamed element or step. In any composition or method disclosed herein, known or disclosed equivalents of any named essential element or step may be substituted for that element or step.

As used herein, the term "substantially" refers to the qualitative condition of exhibiting total or near-total extent or degree of a characteristic or property of interest.

EQUIVALENTS

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system comprising:

a substantially hollow bench configured to discharge climate-controlled air from an interior of the substantially hollow bench to an exterior of the substantially hollow bench;

at least one HVAC unit fluidly and/or thermally coupled to the interior of the substantially hollow bench and configured to deliver the climate-controlled air to the interior of the substantially hollow bench; and a retractable shade comprising:

at least one foot support coupled to the substantially hollow bench;

a shade portion comprising an opaque, flexible material;

multiple vertical members, each vertical member rotatably coupled to the shade portion; and multiple telescoping supports, each telescoping support rotatably coupled to both the shade portion and at least one vertical member of the multiple vertical members.

2. The system of claim 1, wherein the at least one foot support comprises multiple foot supports, wherein each foot support is horizontally oriented and fixedly coupled to a vertical member.

3. The system of claim 1, wherein the opaque flexible material comprises at least one of expanded polytetrafluoroethylene (ePTFE), canvas, polyester, nylon, and linen.

4. The system of claim 1, wherein the shade portion is deployable at different angles defined with the vertical members by expanding or contracting the telescoping members.

5. The system of claim 1, wherein the opaque, flexible material is coupled to at least one spring-loaded roller disposed within a side support of the shade portion such that the opaque, flexible material may be selectively extended across the shade portion when in use, and/or wound around the at least one spring-loaded roller when not in use.

6. The system of claim 1, further comprising a diffusor manifold comprising a diffusor through which air flows from the interior of the substantially hollow bench to the exterior of the substantially hollow bench, the diffusor manifold fluidly coupled to the interior of the substantially hollow bench, wherein the substantially hollow bench forms a fluid duct to the diffusor manifold.

7. The system of claim 6, wherein the substantially hollow bench forms the fluid duct to the diffusor manifold without any internal structural ductwork disposed therein.

8. The system of claim 1, comprising at least one heater box fluidly and/or thermally coupled to at least one of the HVAC unit and the substantially hollow bench.

9. The system of claim 8, wherein the at least one heater box comprises:

a front door that is rotatably coupled via a hinge along a top surface to the rest of the heater box such that it is configured to rotate open;

a front door that is magnetically coupled to the rest of the heater box such that it remains closed when not opened by a user;

multiple side ports for fluidly coupling to one or more hoses that are coupled to the at least one HVAC unit; and/or a transparent top surface.

10. The system of claim 8, wherein the hollow bench comprises at least one removable blank for thermally and/or fluidly coupling to the at least one heater box.

11. The system of claim 8, wherein the at least one heater box comprises at least one exterior surface that is non-orthogonal with the other exterior surfaces of the heater box, and/or wherein the at least one heater box comprises one or more side handles and/or front handles.

12. The system of claim 8, wherein the at least one heater box comprises a first compartment, a second compartment, and a third compartment disposed within an interior volume of the at least one heater box.

13. The system of claim 12, wherein at least two of the first, second, and third compartments are sized such that a full-size football helmet may be placed therewithin, and wherein at least one of the first, second, and third compartments is smaller than the other two compartments.

14. The system of claim 12, wherein the at least one heater box comprises multiple dividing walls separating, and at least partially defining, the first, second, and third compartments, and wherein each dividing wall of the multiple dividing walls comprises at least one cross-connect hole disposed therein, the at least one cross-connect hole fluidly connecting at least one of the first, second, and third compartments to at least one adjacent compartment of the first, second, and third compartments.

15. A system comprising:

a substantially hollow bench configured to discharge climate-controlled air from an interior of the substantially hollow bench to an exterior of the substantially hollow bench;

at least one HVAC unit fluidly and/or thermally coupled to the interior of the substantially hollow bench and configured to deliver the climate-controlled air to the interior of the substantially hollow bench; and a retractable shade comprising at least one foot support coupled to the substantially hollow bench; and at least one heater box fluidly and/or thermally coupled to at least one of the HVAC unit and the substantially hollow bench, wherein the at least one heater box comprises a pentagonal cross-section extending across a lengthwise dimension of the at least one heater box.

16. A system comprising:

a substantially hollow bench configured to discharge climate-controlled air from an interior of the substantially hollow bench to an exterior of the substantially hollow bench;

at least one HVAC unit fluidly and/or thermally coupled to the interior of the substantially hollow bench and configured to deliver the climate-controlled air to the interior of the substantially hollow bench; and a retractable shade comprising at least one foot support coupled to the substantially hollow bench; and at least one heater box fluidly and/or thermally coupled to at least one of the HVAC unit and the substantially hollow bench, wherein the heater box comprises multiple rear surfaces and/or planes that are sized and angled to match corresponding multiple rear surfaces of a diffusor manifold of the substantially hollow bench such that the multiple rear surfaces and/or planes of the heater box are in contact with the corresponding multiple rear surfaces of the diffusor manifold when in operation.

17. A system comprising:

a substantially hollow bench configured to discharge climate-controlled air from an interior of the substantially hollow bench to an exterior of the substantially hollow bench;

at least one HVAC unit fluidly and/or thermally coupled to the interior of the substantially hollow bench and configured to deliver the climate-controlled air to the interior of the substantially hollow bench; and at least one heater box fluidly and/or thermally coupled to at least one of the HVAC unit and the substantially hollow bench, wherein the at least one heater box comprises at least one polymerized and/or rubberized layer disposed on at least one exterior surface of the at least one heater box.

* * * * *